US007856773B2

(12) United States Patent
Agaiby

(10) Patent No.: US 7,856,773 B2
(45) Date of Patent: Dec. 28, 2010

(54) ALL-IN-ONE MODULAR CONSTRUCTION SYSTEM

(76) Inventor: Wagdy Agaiby, 1647- C Bank Street, Ottawa, Ontario (CA) K1V 7Z1

( * ) Notice: Subject to any disclaimer, the term of this patent is extended or adjusted under 35 U.S.C. 154(b) by 1514 days.

(21) Appl. No.: 10/896,914

(22) Filed: Jul. 23, 2004

(65) Prior Publication Data

US 2005/0016082 A1 Jan. 27, 2005

Related U.S. Application Data

(60) Provisional application No. 60/489,490, filed on Jul. 24, 2003.

(51) Int. Cl.
*E04C 1/39* (2006.01)
*E04C 2/52* (2006.01)
*E04B 5/48* (2006.01)

(52) U.S. Cl. ..... 52/220.2; 52/220.3; 52/284; 52/590.2; 52/604; 52/607

(58) Field of Classification Search ..... 52/220.2, 52/220.3, 604–607, 167.4, 167.5, 284, 302.4, 52/590.1, 590.2; 446/127
See application file for complete search history.

(56) References Cited

U.S. PATENT DOCUMENTS

| | | | | | |
|---|---|---|---|---|---|
| 36,546 | A | * | 9/1862 | Commins | 114/12 |
| 378,000 | A | * | 2/1888 | Gibford | 52/590.1 |
| 756,300 | A | * | 4/1904 | Underwood | 52/284 |
| 960,217 | A | * | 5/1910 | Dodds | 52/591.5 |
| 1,216,550 | A | * | 2/1917 | Ciciliani | 52/592.4 |
| 1,254,109 | A | * | 1/1918 | Atterbury | 52/236.7 |
| 1,381,625 | A | * | 6/1921 | Finch | 165/9.1 |
| 1,467,340 | A | * | 9/1923 | Abram | 52/582.1 |
| 1,618,696 | A | * | 2/1927 | Bemis | 52/220.2 |
| 1,727,363 | A | * | 9/1929 | Bone | 52/100 |
| 1,744,185 | A | * | 1/1930 | Waite et al. | 110/336 |
| 1,963,410 | A | * | 6/1934 | Kartowicz | 52/481.2 |
| 1,981,324 | A | * | 11/1934 | Peterson | 52/591.2 |
| 2,104,307 | A | * | 1/1938 | Miller | 144/354 |
| 2,225,612 | A | * | 12/1940 | Allen | 52/586.2 |
| 2,325,254 | A | * | 7/1943 | Lefebure | 52/241 |
| 3,338,013 | A | * | 8/1967 | Graham et al. | 52/302.3 |
| 3,391,507 | A | * | 7/1968 | Downing | 52/314 |
| 3,643,389 | A | * | 2/1972 | Sheppley, Jr. | 52/79.1 |
| 3,732,650 | A | * | 5/1973 | Gwilliam et al. | 52/220.2 |
| 3,881,283 | A | * | 5/1975 | Pender | 52/79.13 |
| 3,890,748 | A | * | 6/1975 | Fencl | 52/79.1 |
| 3,950,902 | A | * | 4/1976 | Stout | 52/91.2 |
| 3,971,598 | A | * | 7/1976 | Rudge | 384/36 |
| 4,007,555 | A | * | 2/1977 | Sasaoka | 446/127 |

(Continued)

*Primary Examiner*—Robert J Canfield
(74) *Attorney, Agent, or Firm*—Teitelbaum & MacLean; Neil Teitelbaum; Doug MacLean

(57) ABSTRACT

The invention relates to a modular construction system for full size or toy/model size buildings. The basic structure is made of interconnectable panels, which are grouped into four main types: base panels, wall panels, ceiling panels, and roof panels. Each panel has a plurality of service conduits extending therethrough for passing all of the service requirements for the building, e.g. electrical, plumbing, air conditioning, vacuum etc, without having to cut or drill through the existing structure. Each vertical wall panel has upper and lower connector blocks for mating with the horizontal ceiling and base panels, respectively. The connector blocks also align the service conduits of the wall panel with the service conduits of the ceiling and base panels.

21 Claims, 51 Drawing Sheets

U.S. PATENT DOCUMENTS 4,010,581 A * 3/1977 Keturi et al. ..... 52/220.2
4,320,549 A * 3/1982 Greb ..... 14/73.5
4,719,738 A * 1/1988 Lee ..... 52/607
4,731,971 A * 3/1988 Terkl ..... 52/742.14
4,856,238 A * 8/1989 Kesting ..... 52/220.2
4,896,469 A * 1/1990 Wright ..... 52/220.2
5,035,100 A * 7/1991 Sachs ..... 52/745.05
5,222,342 A * 6/1993 Defferrari ..... 405/284
5,293,725 A * 3/1994 Matticks et al. ..... 52/271
5,465,541 A * 11/1995 Lin et al. ..... 52/220.2
5,519,971 A * 5/1996 Ramirez ..... 52/220.2
5,588,269 A * 12/1996 Wagner ..... 52/270
5,666,778 A * 9/1997 Grattan et al. ..... 52/606
5,729,944 A * 3/1998 De Zen ..... 52/439
5,921,046 A * 7/1999 Hammond, Jr. ..... 52/564
5,964,067 A * 10/1999 Lehner et al. ..... 52/220.2
5,987,827 A * 11/1999 Lord ..... 52/274
5,992,108 A * 11/1999 Falcey ..... 52/220.2
6,164,026 A * 12/2000 Ehrenkrantz ..... 52/220.2
6,216,410 B1 * 4/2001 Haberman ..... 52/591.1
6,240,693 B1 * 6/2001 Komasara et al. ..... 52/439
6,305,142 B1 * 10/2001 Brisson et al. ..... 52/742.14
6,536,168 B1 * 3/2003 Cugini et al. ..... 52/220.2
6,845,591 B1 * 1/2005 Klein-Holte et al. ..... 52/220.1
6,860,073 B2 * 3/2005 Chien ..... 52/220.1
7,191,571 B2 * 3/2007 Schools et al. ..... 52/607
2008/0250736 A1 * 10/2008 Breaz ..... 52/220.2

* cited by examiner 42
54a
54b
51
48a
48f
43
53a
53b
49a
49b
47a
47b
47c
47d
47e
47f
41
2'
2''
2
44
62
63

ALL-IN-ONE MODULAR CONSTRUCTION SYSTEM

CROSS-REFERENCE TO RELATED APPLICATIONS

The present invention claims priority from U.S. Patent Application No. 60/489,490 filed Jul. 24, 2003, which is incorporated herein by reference.

TECHNICAL FIELD

The present invention relates to a modular construction system, and in particular to a modular construction system including interlocking panels with interconnecting service conduits extending therethrough for use in full-size or miniature (toy) construction systems.

BACKGROUND OF THE INVENTION

Conventional construction techniques require wood framing to be fastened together on top of a cinderblock or cement foundation. Holes must then be cut in the framing and foundation to run the required services, such as heating, plumbing and electricity. Subsequently, an exterior facade of bricks or siding is placed over the framing, while a finished surface of drywall or plaster is mounted on the interior surface of the framing. All of these steps are quite labor intensive, requiring various different specialized teams of laborers. This type of construction also results in a great deal of waste, which must be cleaned up from the construction cite, and disposed of at a remote dumping cite.

Conventional modular construction techniques do not simplify or limit the labor requirements, they simply move some preliminary work inside the builder's warehouse. The same holes must be cut in the framing, and the same waste is produced by the assembly. Moreover, large prefabricated portions of the structure must be transported to the construction cite using special equipment with increased cost. Furthermore, the prefabricated portions are specific to one type of house, and not useable for different structural designs.

Conventional building block toys, such as Lego®, provide a plurality of interlocking blocks for constructing anything from rectangular structures to detailed space ships Recent developments in building blocks include all different shapes and sizes. However, none have been developed including interconnecting service conduits for running parallel electrical wiring and water systems between perpendicular walls. Moreover, none have been developed with specially designed base panels, wall panels and ceiling panels.

An object of the present invention is to overcome the shortcomings of the prior art by providing a modular construction system including prefabricated interlocking panels with interconnecting service conduits for use in a variety of different housing designs both full size and miniature.

SUMMARY OF THE INVENTION

Accordingly, the present invention relates to a modular construction system for a full-size or miniature structure comprising a plurality of interlocking panels, each panel including:

a plurality of parallel service conduits extending longitudinally therethrough;

a plurality of access conduits extending laterally therein for accessing the service conduits; and connectors for interlocking adjacent panels and for aligning the service conduits of adjacent panels.

BRIEF DESCRIPTION OF THE DRAWINGS

The invention will be described in greater detail with reference to the accompanying drawings which represent preferred embodiments thereof, wherein:

FIG. 33*a* is an isometric view of a 45° angled base panel;

FIG. 33*b* is an isometric view of the angled base panel of FIG. 33*a* from below;

FIG. 33*c* is an isometric view of the angled base panel of FIG. 33*a* with the outer surface removed;

FIG. 46 is an isometric view of a wall panel for the swimming pool of FIG. 44;

DETAILED DESCRIPTION

Figure 1:
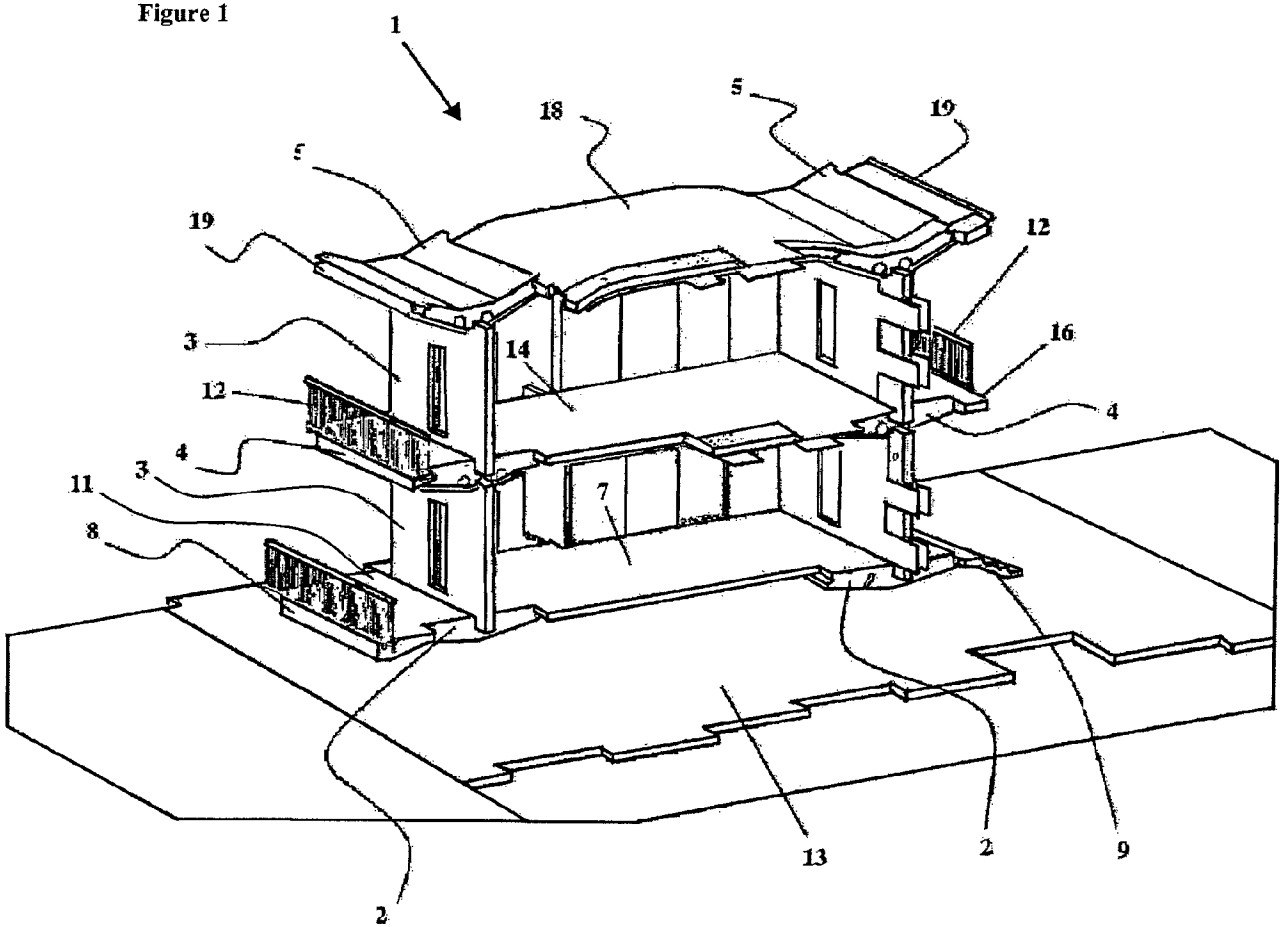
FIG. 1 illustrates a partially constructed building according to the present invention.
Figure 2:
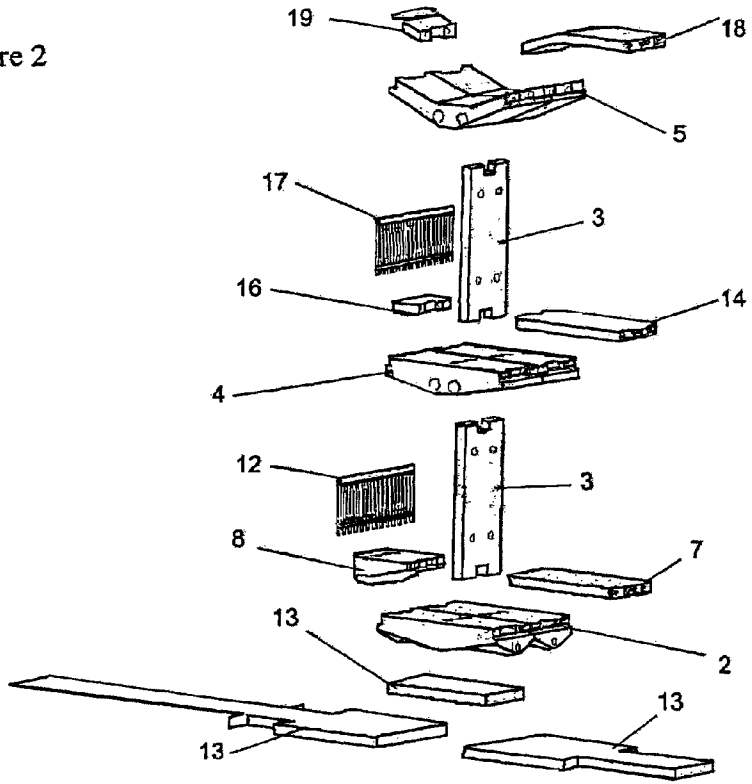
FIG. 2 illustrates an exploded view of a partially constructed building.

With reference to FIGS. 1 and 2, a modular building according to the present invention, generally indicated at 1, includes four main types of interlocking building panels, i.e. base panels 2, wall panels 3, ceiling panels 4 and roof panels 5. The interlocking base panels 2 define the perimeter of the building 1 and provide support for any vertical wall panels 3 making up the first level of the building 1. Additional inner base slab panels 7 are connected to the base panels 2 to form the middle portion of the ground floor. Outside of the building 1, specialty exterior panels, e.g. flower box panels 8, stair panels 9 or deck panels 11 can be connected to the base panels 2 depending on the needs of the owner. The deck panels 11 and the flower box panels 8 include hand rails 12. The base panels 2 can be mounted directly onto bedrock, onto a concrete slab, or onto footing panels 13 provided.

The interlocking ceiling panels 4 are mounted on the upper ends of the ground wall panels 3 providing cantilevered arms extending outwardly therefrom. Ceiling slab panels 14 are attached to the cantilever arm extending into the building, while specialized exterior panels, e.g. shade panels 16 and hand rail panels 17, are mounted on the cantilever arm extending outwardly from the side of the building 1.

The interlocking roof panels 5 are mounted on the upper ends of the second floor wall panels 3 providing cantilevered arms extending outwardly and upwardly therefrom. Roof slab panels 18 are attached to the cantilever arm extending over the building 1, while specialized exterior panels, e.g. shade panels 19, can be mounted on the cantilever arm extending away from the building 1. While only a two story building is illustrated, any number of floors can be constructed with the building system according to the present invention.

Figure 3:
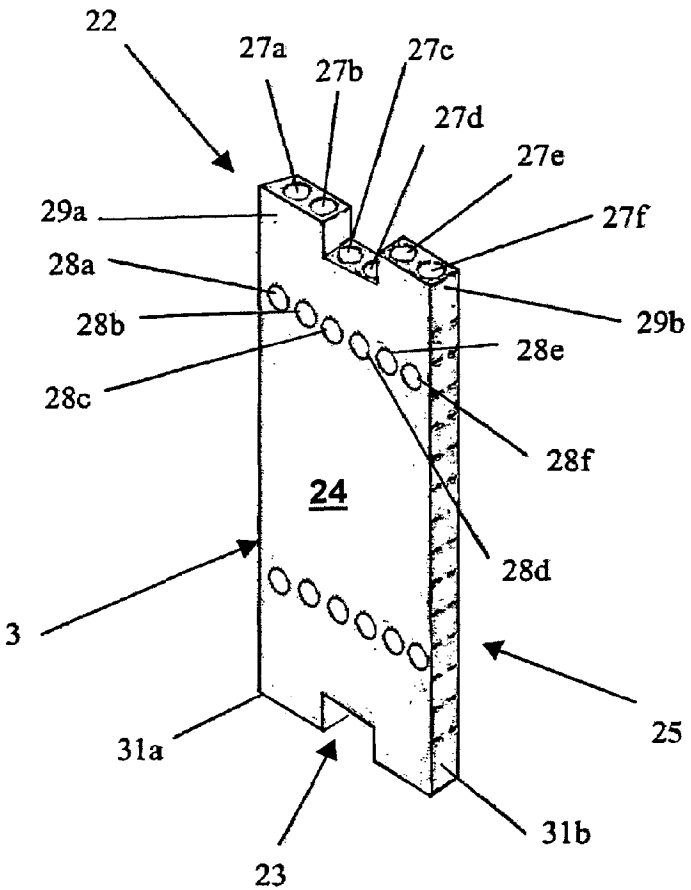
FIG. 3 is an isometric view of a wall panel.
Figure 4:
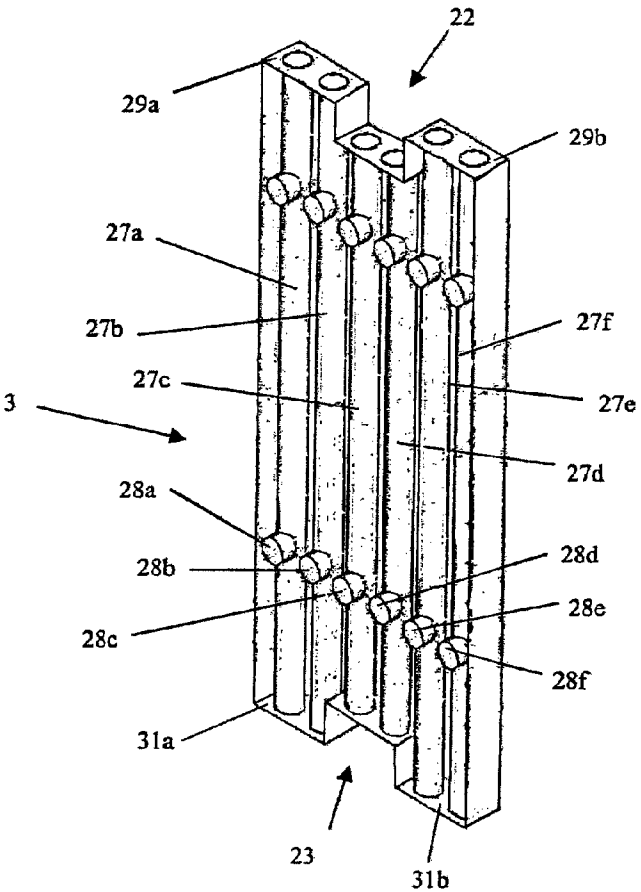
FIG. 4 is an isometric view of the wall panel of FIG. 3 with the outer surface removed.
Figure 6:
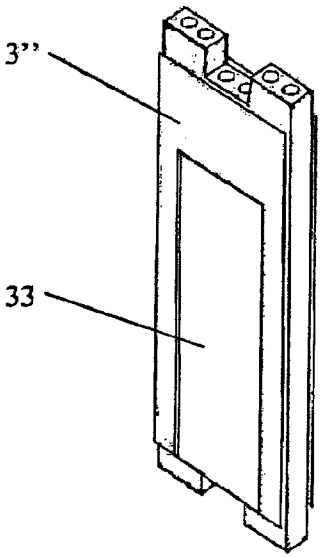
FIG. 6 is an isometric view of an alternative wall panel.
Figure 5:
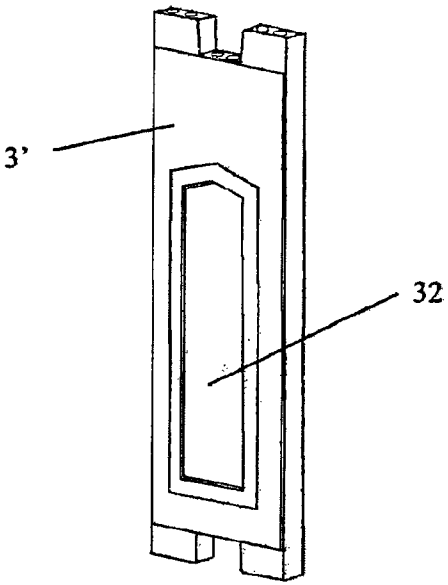
FIG. 5 is an isometric view of an alternative wall panel.
Figures 7, 8, 9, 10:
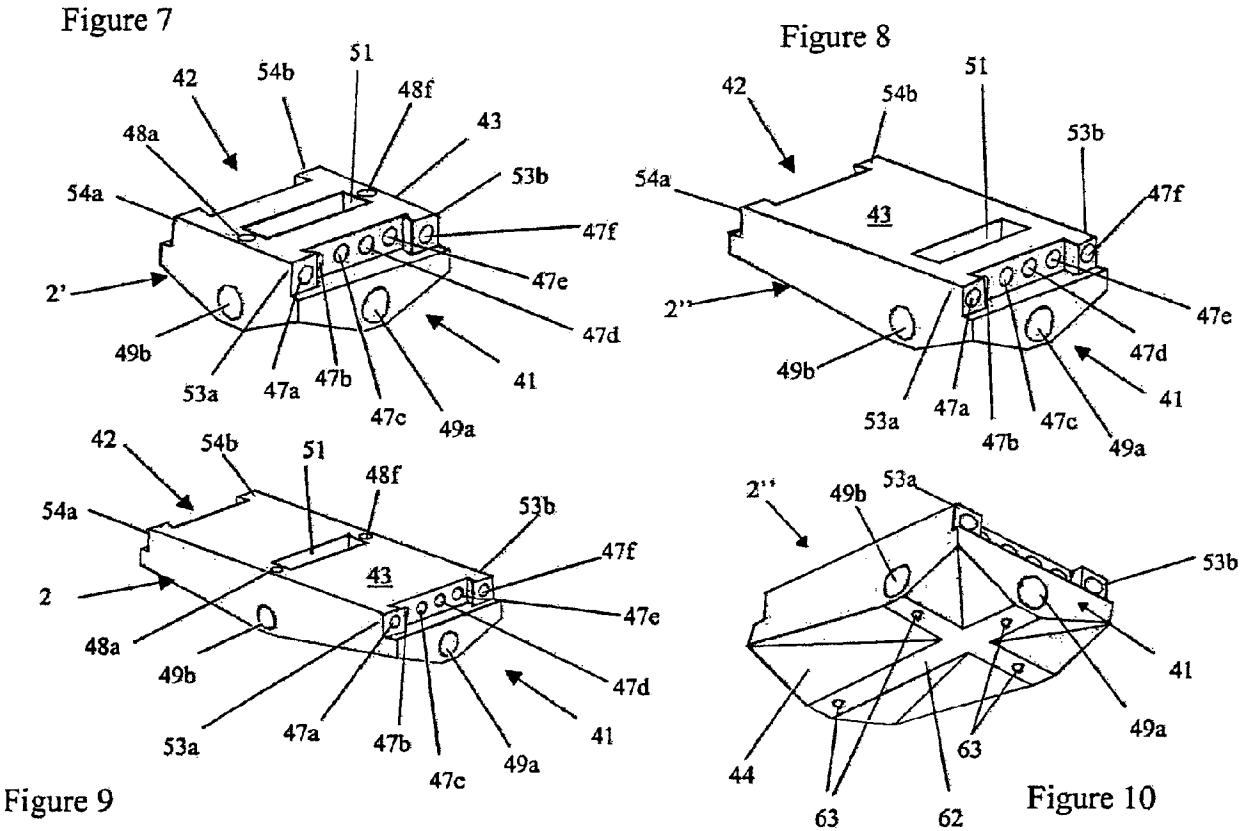
FIG. 7 is an isometric view of a base panel.
FIG. 8 is an isometric view of an alternate base panel.
FIG. 9 is a partially exploded isometric view of a base panel and wall panel assembly.
FIG. 10 is an isometric view of the base panel of FIG. 8 from below
Figure 11:
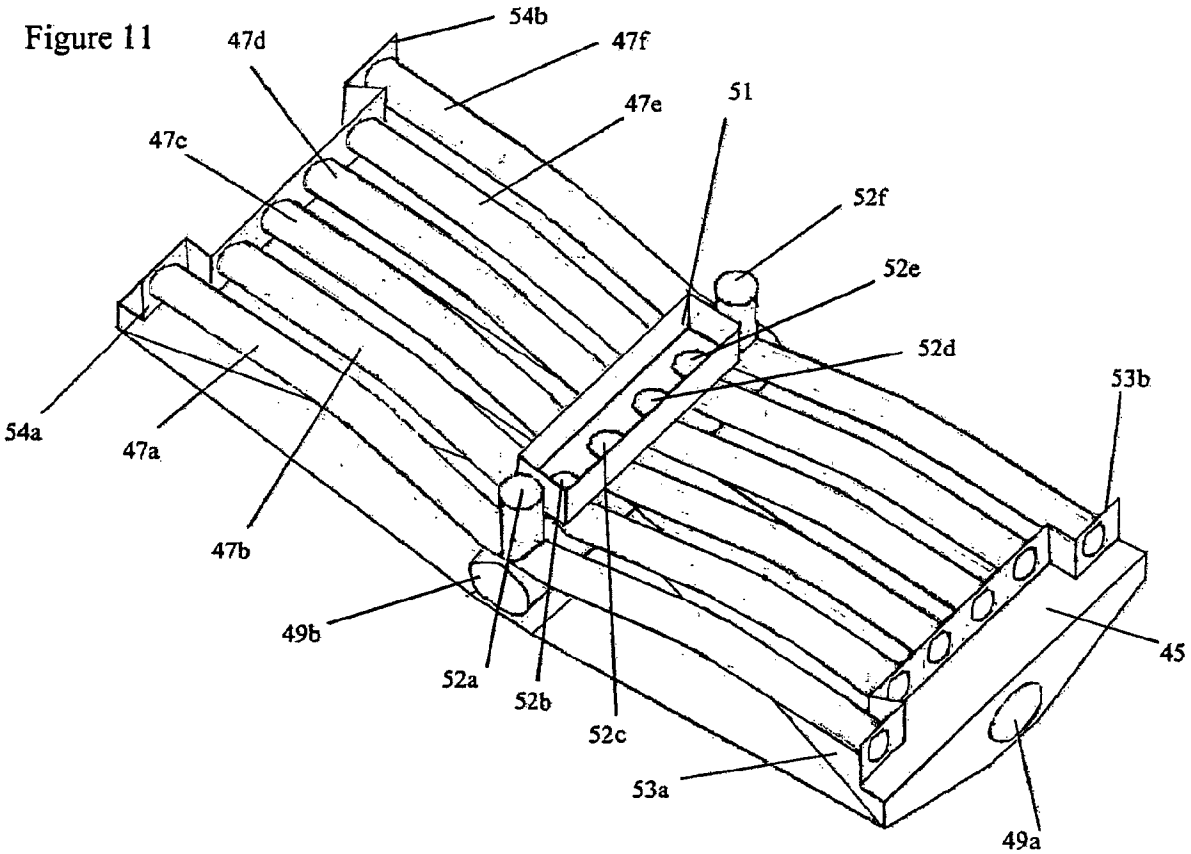
FIG. 11 is an isometric view of the base panel of FIG. 9 with the outer surface removed.
Figure 12B:
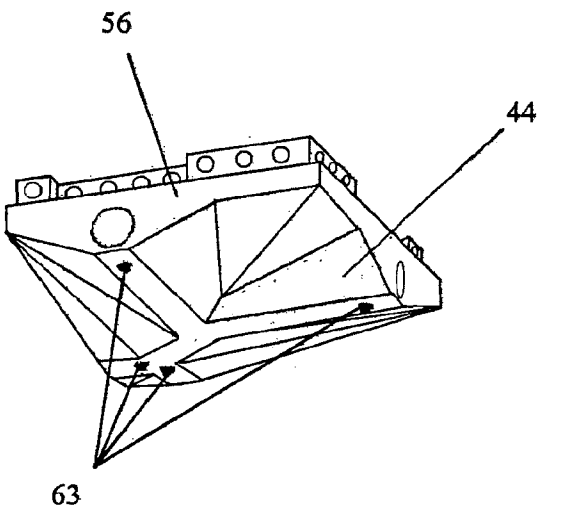
FIG. 12*b* is an isometric view of the 90° corner base panel of FIG. 12*a* from below.
Figure 12A:
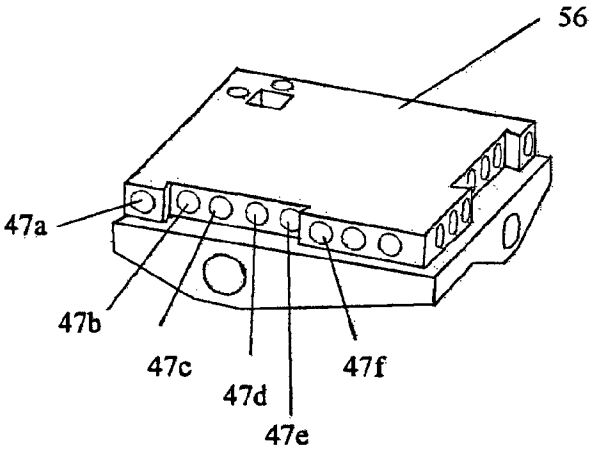
FIG. 12*a* is an isometric view of a 90° corner base panel.
Figure 13A:
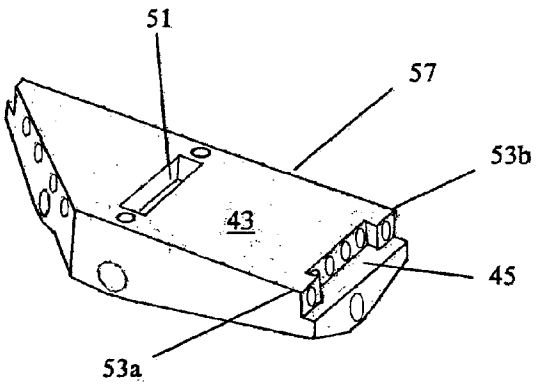
FIG. 13*a* is an isometric view of a 45° corner base panel.
Figure 13B:
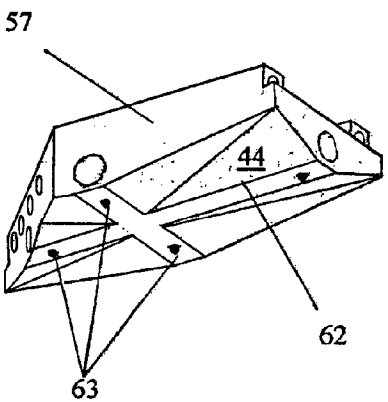
FIG. 13*b* is an isometric view of the 45° corner base panel of FIG. 13*a* from below.
Figure 14B:
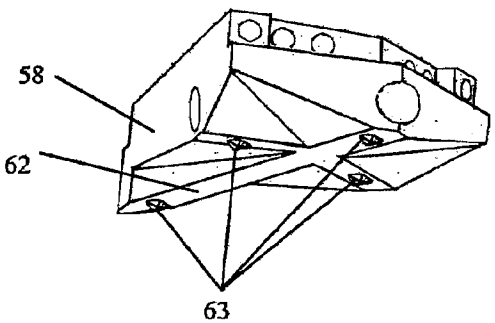
FIG. 14*b* is an isometric view of the angled base panel of FIG. 14*a* from below.
Figure 14A:
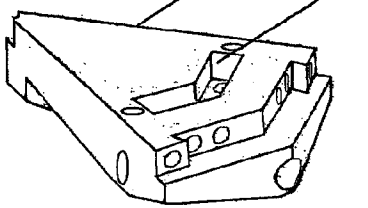
FIG. 14*a* is an isometric view of an angled base panel.
Figure 14C:
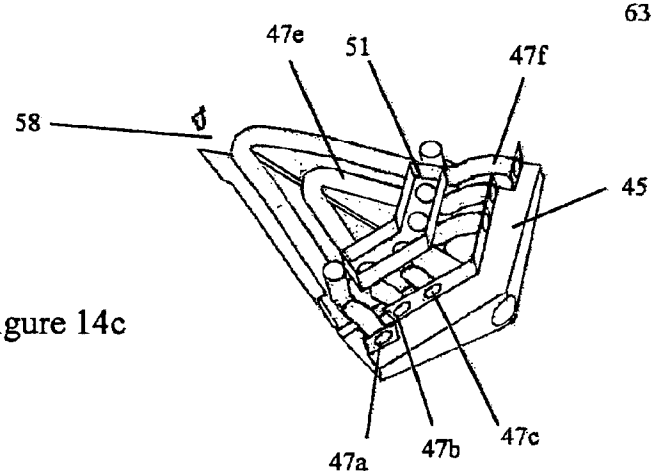
FIG. 14*c* is an isometric view of the angled base panel of FIG. 14*a* with the outer surface removed.
Figure 15B:
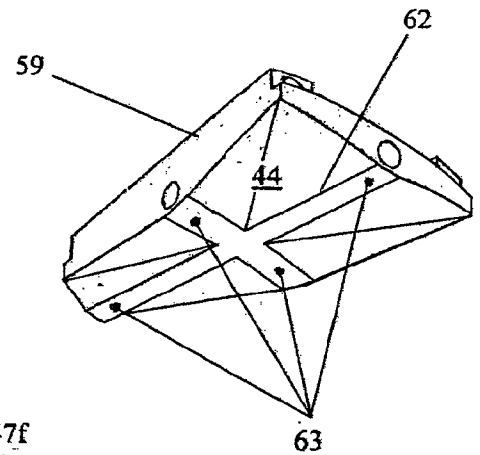
FIG. 15*b* is an isometric view of the angled base panel of FIG. 15*a* from below.
Figure 15A:
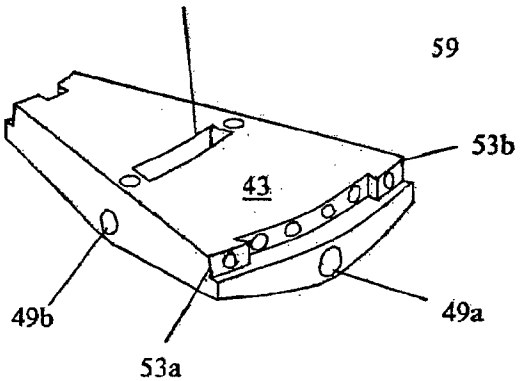
FIG. 15*a* is an isometric view of an angled base panel with a rounded end.
Figure 15C:
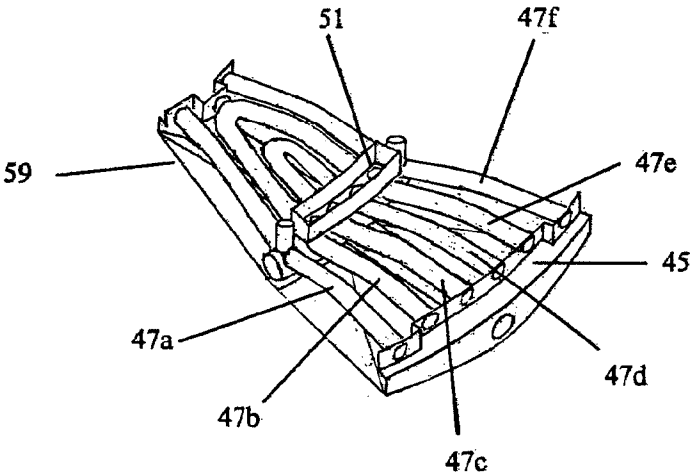
FIG. 15*c* is an isometric view of the angled base panel of FIG. 15*a* with the outer surface removed.
Figure 16A:
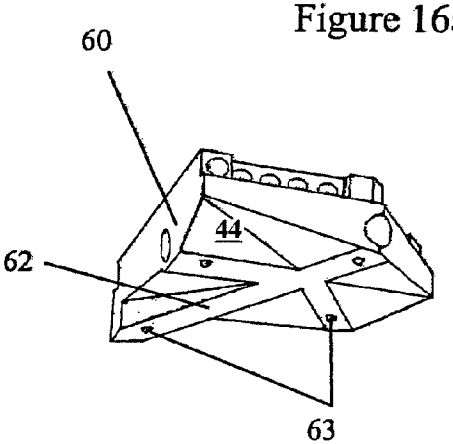
FIG. 16*a* is an isometric view of an alternative angled base panel.
Figure 16B:
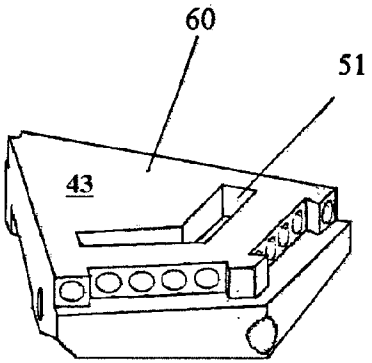
FIG. 16*b* is an isometric view of the angled base panel of FIG. 16*a* from below.
Figure 17:
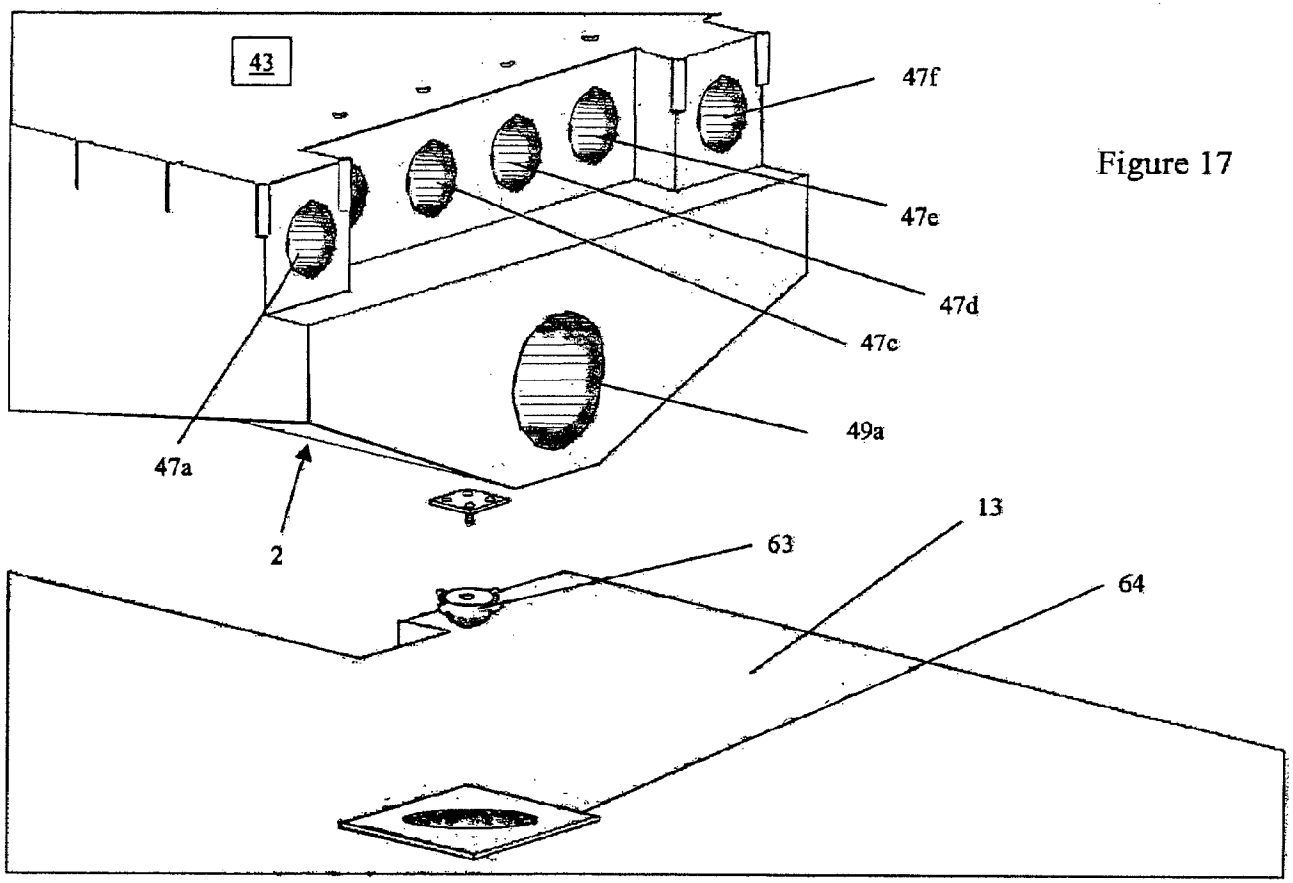
FIG. 17 is an exploded view of a bearing structure between the base panels and the footing.
Figure 18:
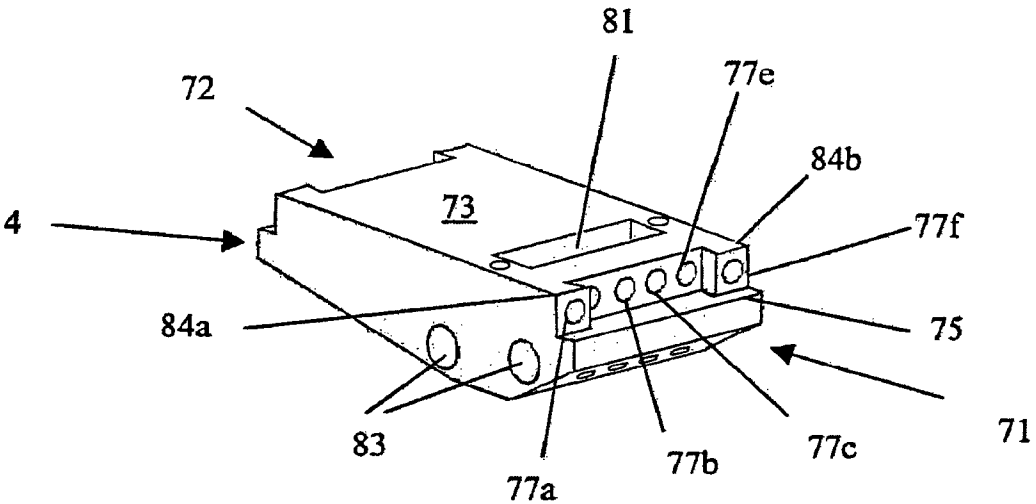
FIG. 18 is an isometric view of a ceiling panel.
Figure 19:
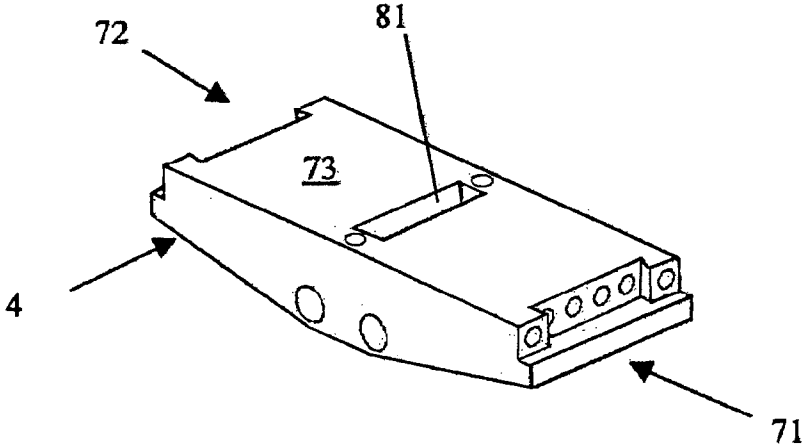
FIG. 19 is an isometric view of an alternative ceiling panel.
Figure 20A:
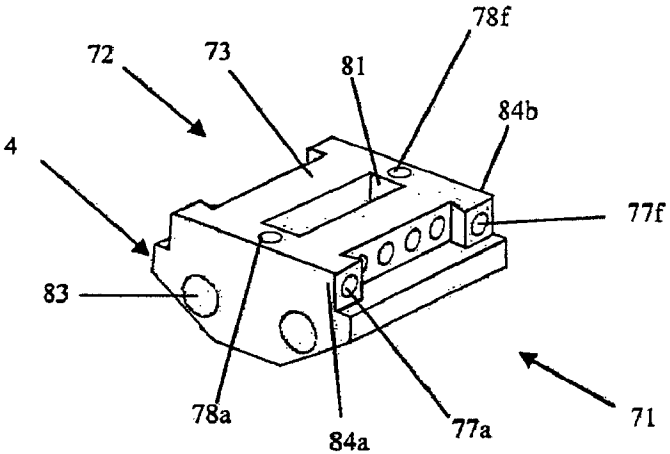
FIG. 20*a* is an isometric view of a third ceiling panel.
Figure 20B:
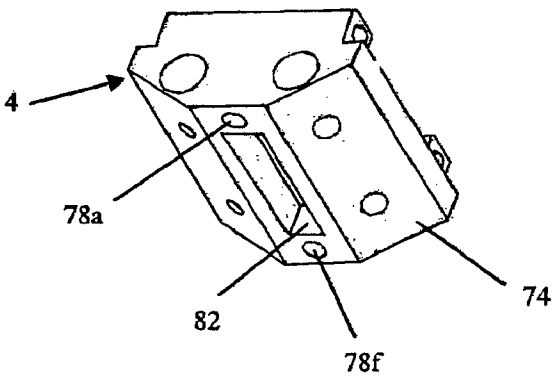
FIG. 20*b* is an isometric view of the ceiling panel of FIG. 20*a* from below.
Figure 21:
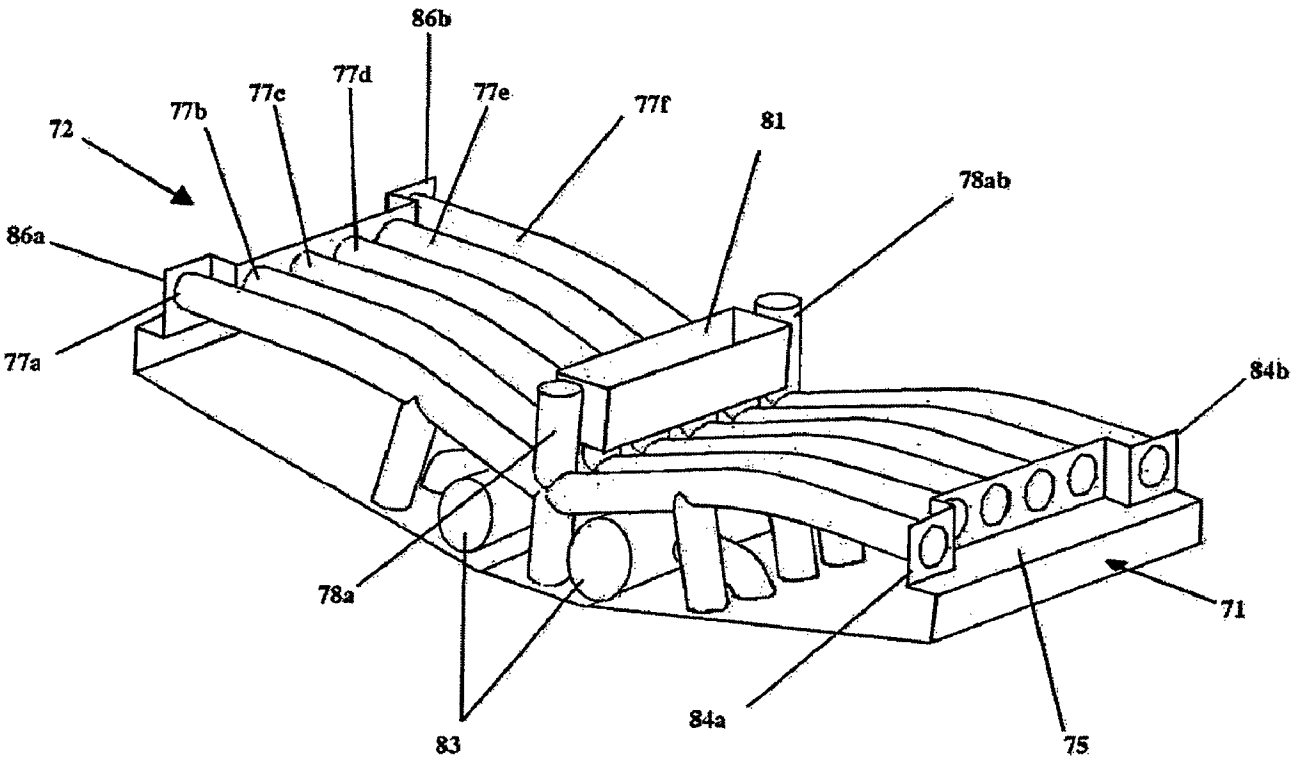
FIG. 21 is an isometric view of the ceiling panel of FIG. 19 with the outer surface removed.

Typical wall panels 3, illustrated in FIGS. 3 and 4, include an upper end 22, a lower end 23, a front face 24, and a back face 25. The wall panels can be made out of a variety of suitable materials, such as concrete, wood, plastic, polymer, fiberglass, or a combination thereof. A plurality of service conduits 27*a* to 27*f* extend from the upper end 22 to the lower end 23. The service conduits 27*a* to 27*f* enable all of the services, e.g. plumbing, electrical, central vacuum, and HVAC (heating, ventilating and air conditioning) to be easily run wherever necessary throughout the building without necessitating cutting or drilling. Each service conduit 27*a* to 27*b* includes at least one, but preferably two, access conduits 28*a* to 28*f*, which extend from the service conduit to the front and/or the rear faces 24 and 25, respectively, of the wall panels 3. The access conduits 28*a* to 28*f* enable the builder or the building owner to access the various service conduits whenever desired, in particular, for positioning fixtures, such as lights, electrical outlets, water taps, vacuum cleaner sockets, cold air returns, and air vents. Extending upwardly from the upper end 22 are upper connector blocks 29*a* and 29*b* acting as male connectors for connecting the wall panel 3 to a pair of ceiling panels, as will be described hereinafter. Extending downwardly from the lower end 23 are lower connector blocks 31*a* and 31*b* acting as male connectors for connecting the wall panel 3 to a pair of base panels 2, as will be described hereinafter. Each connector block 29*a* and 31*a* includes the ends of service conduits 27*a* and 27*b*, while each of connector blocks 29*b* and 31*b* includes the ends of service conduits 27*e* and 27*f*, although more or less service conduits in each connector block is possible. Positioning the ends of the service conduits 27*a*, 27*b*, 27*e*, and 27*f* in the connector blocks 29*a*, 29*b*, 31*a*, and 31*b* facilitates the alignment thereof with access conduits, i.e. service conduits, in adjoining base, ceiling or roof panels. Specialty wall panels 3' and 3", FIGS. 5 and 6, are designed to provide windows 32 and doors 33, respectively.

Base panels 2 come in various sizes, as illustrated in FIGS. 7 to 11, depending upon the specific needs of the building. Each base panel 2 includes an inner end 41, an outer end 42, a top surface 43, and a bottom surface 44. A shoulder 45 is provided at the inner and outer ends 41 and 42, respectively, providing a mounting surface for supporting the inner base slabs 7. As in the wall panels 3, each base panel 2 includes a plurality of service conduits 47*a* to 47*b* extending from the outer end 42 to the inner end 41. The base panels 2 also include an additional service conduit 49*a* below the service conduits 47*a* to 47*f* with a lateral service conduit 49*b* extending perpendicular thereto. The additional and lateral service conduits 49*a* and 49*b* can have larger diameters than the regular service conduits 47*a* to 47*f* for transporting higher volumes of air or larger drainage pipes. At least one of the regular service conduits, e.g. 47*a*, can be connected to the additional and lateral service conduits 49*a* and 49*b*, if necessary. The upper surface 43 includes a connector recess 51 acting as a female connector for receiving a connector block 31*b* from a first wall panel 3 and a connector block 31*a* from a second wall panel 3, in the preferred overlapping construction arrangement. Connector access conduits 52*a* to 52*f* extend from the service conduits 47*a* to 47*f*, respectively, to the connector recess 51 for aligning with the service conduits 27*a* to 27*f* of one or a combination of the wall panels 3. In the overlapping arrangement, service conduits 27*d*, 27*e* and 27*f* from the fast wall panel 3 become aligned with connector conduits 52*a*, 52*b* and 52*c*, respectively, of the base panel 2, while service conduits 27*a*, 27*b* and 27*c* of the second wall panel 3 become aligned with connector conduits 52*d*, 52*e* and 52*f*, respectively, of the base panel 2. The connector recess 51 can be positioned in the middle of the upper surface 43 or proximate one end thereof (see FIG. 9) depending on the needs of the builder.

The inner end 41 of the base panels 2 includes mating surfaces in the form of connector blocks 53*a* and 53*b* for interlocking and aligning with corresponding mating surfaces on the base slab panels 7. The outer end 42 includes another mating surface in the form of connector blocks 54*a* and 54*b* for interlocking and aligning with corresponding mating surfaces on the specialty panels, e.g. flower box 8. The connector blocks 53*a* and 54*a* include one or more service conduits, e.g. 47*a*, extending therethrough, while the connector blocks 53*b* and 54*b* include one or more service conduits, e.g. 47*f*, extending therethrough to facilitate the alignment of the service conduits 47*a* to 47*f* with those of adjoining base panels.

90° corner base panels 56 or a matching pair of 45° corner base panels 57 are positioned at the intersection of two perpendicular walls for joining the base panels 2 and the wall panels 3. Angled base panels 58, 59 and 60 (FIGS. 14*a*, 14*b*, 15*a*, 15*b*, 16*a*, and 16*b*) enable buildings to be constructed with rounded or non-perpendicular corners. Angled base panel 58 is defined by a 45° angle between sides. Angled base panel 59 includes an arcuate end for constructing a rounded corner or a completely circular building. Angled base panel 60 is defined by a 60° angle between sides.

With reference to FIGS. 10, 12*b*, 13*b*, and 14, the lower surface 44 of the base panels 2 includes beveled corners, leaving only a t-shaped bearing surface 62. A domed-shaped bearing 63 is mounted on each arm of the t-shaped bearing surface 62 for mating with inverted dome shaped bearing plates 64 positioned on the footing panels 13. Accordingly, in the event of an earthquake, the base panels 2 (i.e. the bearings 63) will be able to move relative to the footing panels (i.e. the bearing plates 64), but will be able to return to their normal position, due to the inverted domed shape of the bearing plates 64.

As illustrated in FIGS. 18, 19, 20*a* and 20*b*, ceiling panels 4 can take on various sizes and shapes; however, each includes an inner end 71, an outer end 72, an upper face 73, and a lower face 74. A shoulder 75 is provided at the inner and outer ends 71 and 72, respectively, providing a mounting surface for supporting the ceiling slabs 14. Service conduits 77*a* to 77*f* extend from the inner end 71 to the outer end 72, with connector access conduits 78*a* to 78*b* extending upwardly from the service conduits 77*a* to 77*b*, respectively, to the upper face 73 and downwardly to the lower face 74. A first connector recess 81 is provided in the upper surface 73 for receiving the lower connector blocks 31*a* and 31*b* of the wall panels 3 making up the second story, and a second connector recess 82 is provided in the lower surface 74 for receiving the upper connector blocks 32*a* and 32*b* of the wall panels 3 making up first story.

One or more lateral service conduits 83 can be provided beneath the regular service conduits 77*a* to 77*f* and perpendicular thereto. The lateral service conduits 83 have a larger diameter than the regular service conduits 77*a* to 77*f* for accommodating larger plumbing pipes or larger volumes of air, e.g. for cold air returns. One or more of the regular service conduits, e.g. 77*b*, are connected to the lateral service conduit 83. Connector blocks 84*a* and 84*b* extend from the inner end 71 for connecting and aligning the service conduits 77*a* to 77*f* with ceiling slab panels 14 and the service conduits therein. Connector blocks 86*a* and 86*b* extend from the outer end 72 providing mating surfaces for connecting and aligning the service conduits 77*a* to 77*f* with the ceiling shade panels 16 and the service conduits therein.

Figure 22A:
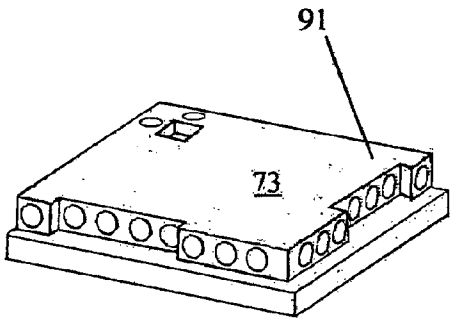
FIG. 22*a* is an isometric view of a 90° corner ceiling panel.
Figure 22B:
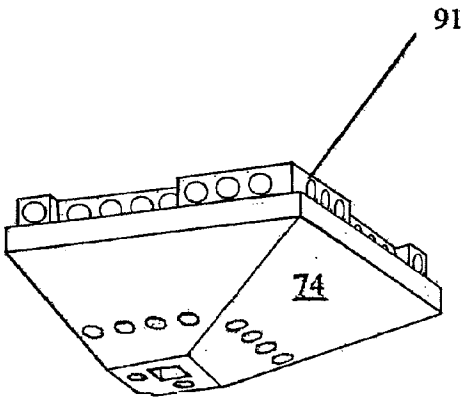
FIG. 22*b* is an isometric view of the 90° corner ceiling panel of FIG. 22*a* from below.
Figure 23A:
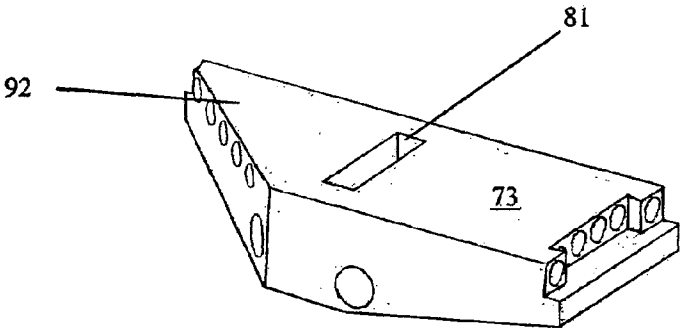
FIG. 23*a* is an isometric view of a 45° corner ceiling panel.
Figure 23B:
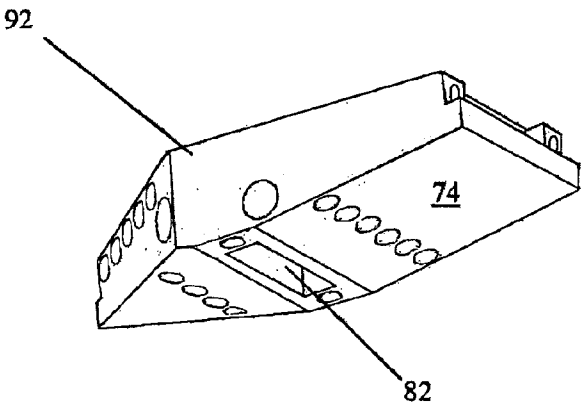
FIG. 23*b* is an isometric view of the 45° corner ceiling panel of FIG. 23*a* from below.
Figure 24A:
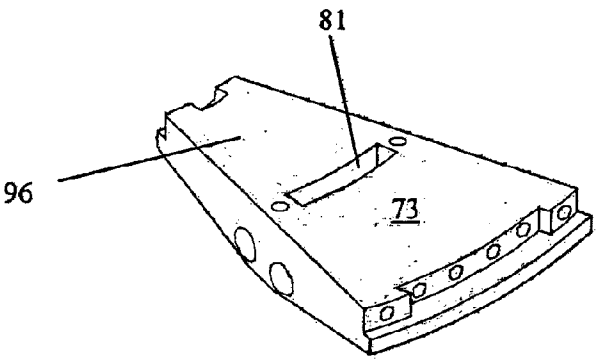
FIG. 24*a* is an isometric view of an angled base panel with a rounded end.
Figure 24B:
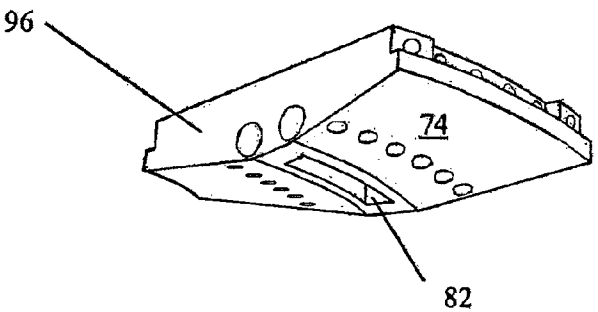
FIG. 24*b* is an isometric view of the angled base panel of FIG. 24*a* from below.
Figure 25A:
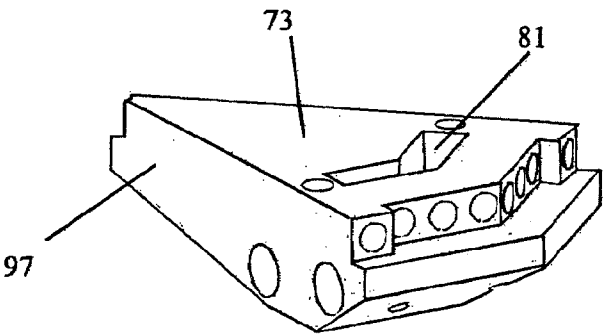
FIG. 25*a* is an isometric view of an angled base panel.
Figure 25B:
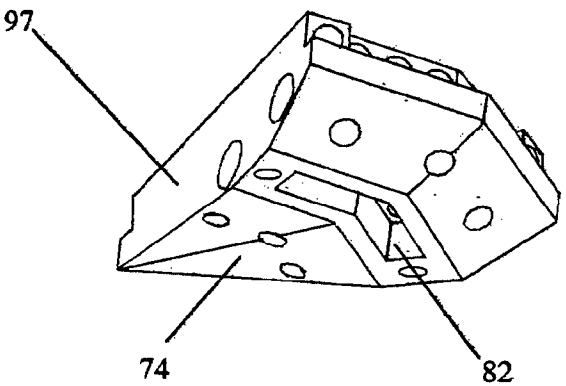
FIG. 25*b* is an isometric view of the angled base panel of FIG. 25*a* from below.
Figure 26A:
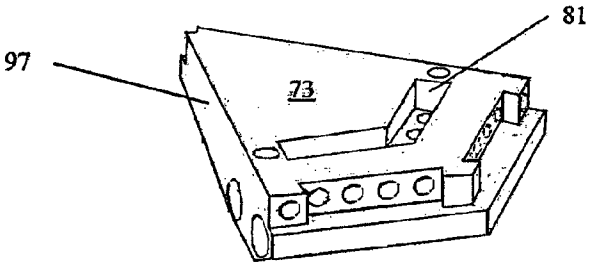
FIG. 26*a* is an isometric view of an alternative angled base panel.
Figure 26B:
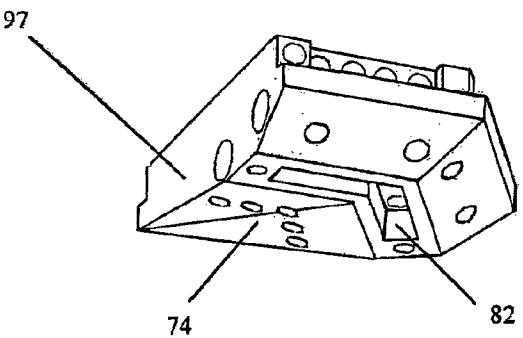
FIG. 26*b* is an isometric view of the angled base panel of FIG. 26*a* from below.
Figure 27A:
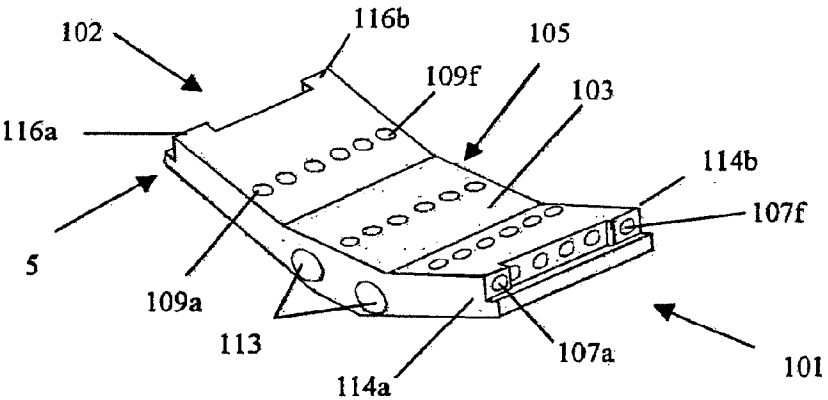
FIG. 27*a* is an isometric view of a roof panel.
Figure 27B:
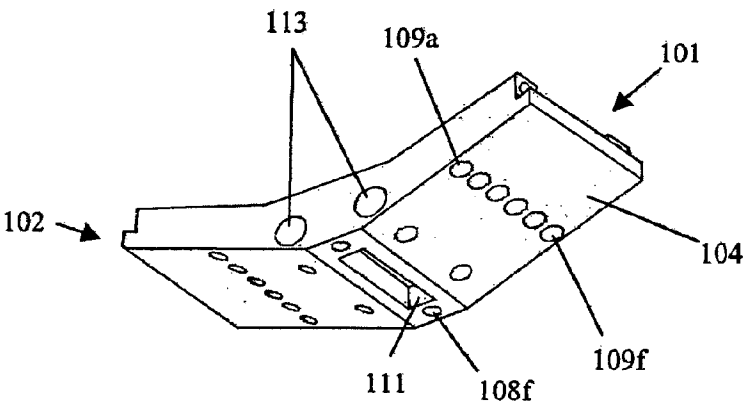
FIG. 27*b* is an isometric view of the roof panel of FIG. 27*a* from below.
Figure 28:
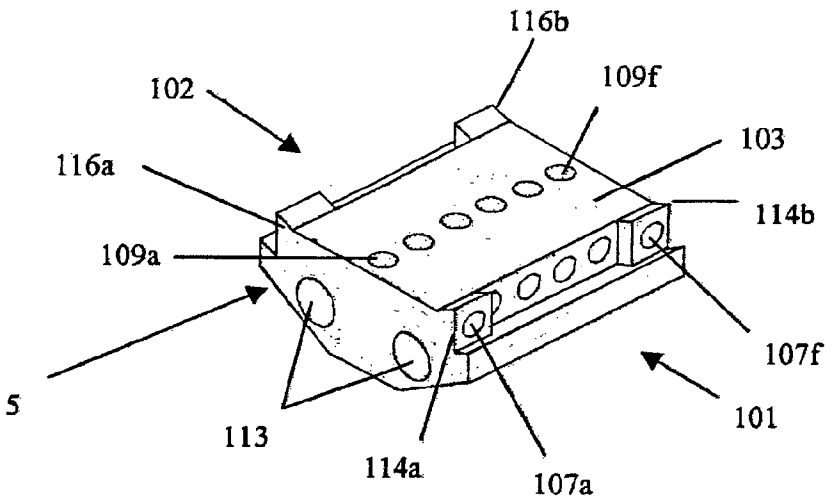
FIG. 28 is an isometric view of an alternative roof panel.
Figure 29:
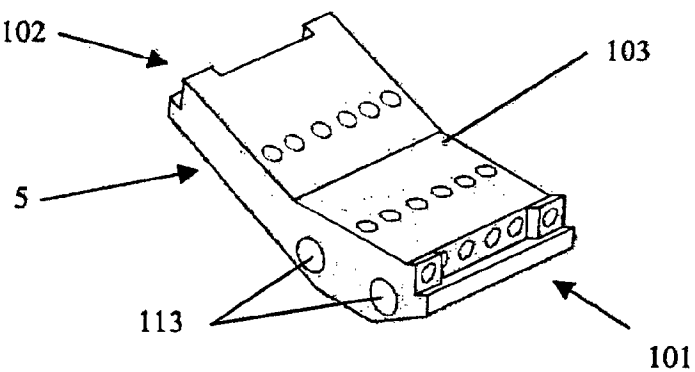
FIG. 29 is an isometric view of another alternative roof panel.
Figure 30:
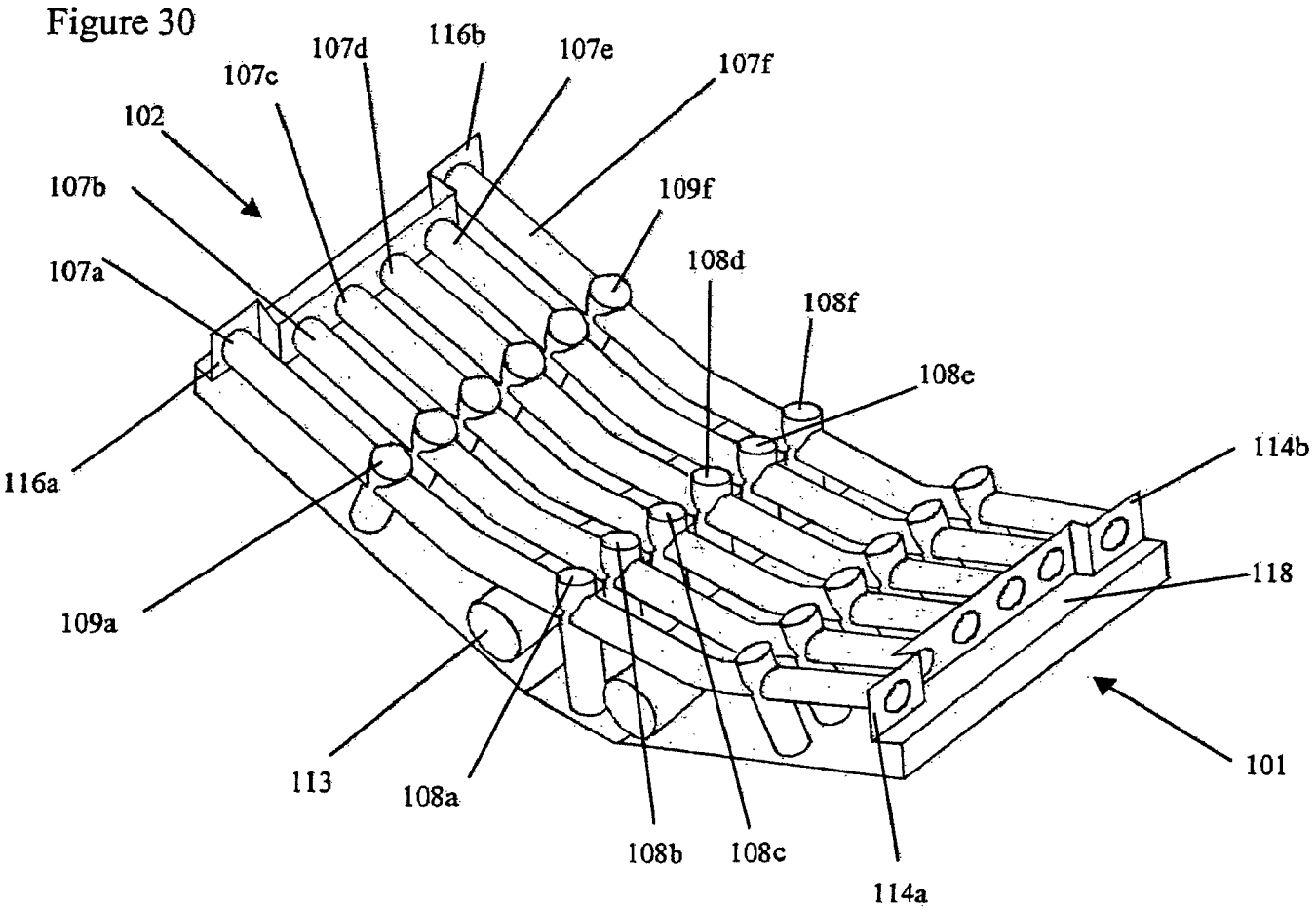
FIG. 30 is an isometric view of the roof panel of FIGS. 27*a* and 27*b* with the outer surface removed.

Similar to base panels 2, a 90° corner ceiling panel 91 (FIGS. 22*a* and 22*b*) or two 45° corner ceiling panels 92 (FIGS. 23*a* and 23*b*) are provided for the intersection of perpendicular walls. Angled ceiling panels 96, 97 and 98 (FIGS. 24*a*, 24*b*, 25*a*, 25*b*, 26*a* and 26*b*) are provided for rounded or non-perpendicular walls.

As illustrated in FIGS. 27*a*, 27*b*, 28, and 29, roof panels 5 can take on various sizes and shapes; however, each includes an inner end 101, an outer end 102, an exterior face 103, and an interior face 104. The inner end 101 and the outer end 102 extends upwardly from a middle section 105 forming a contoured roof structure. Service conduits 107*a* to 107*f* extend from the inner end 101 to the outer end 102, with connector access conduits 108*a* to 108*f* extending downwardly to the interior face 104. A single connector recess 111 is provided in the lower surface 104 for receiving the upper connector blocks 32*a* and 32*b* of a pair of wall panels 3 making up a second (top) story. Several access conduits 109*a* to 109*f* extend upwardly from the service conduits 107*a* to 107*f* to the upper surface 105 and downwardly to the lower surface 104.

One or more lateral service conduits 113 can be provided beneath the regular service conduits 107*a* to 107*f* and perpendicular thereto. The lateral service conduits 113 have a larger diameter than the regular service conduits 107*a* to 107*f* for accommodating larger plumbing pipes or larger volumes of air, e.g. for cold air returns. One or more of the regular service conduits, e.g. 107*b*, can be connected to the lateral service conduit 113. Connector blocks 114*a* and 114*b* acting as a mating surface extend from the inner end 101 for connecting and aligning the service conduits 107*a* to 107*f* with corresponding mating surfaces on the roof slab panels 18 and the service conduits therein. Connector blocks 116*a* and 116*b* act as a mating surface, and extend from the outer end 102 for connecting and aligning the service conduits 107*a* to 107*f* with corresponding mating surfaces on the roof shade panels 19 and the service conduits therein. A shoulder 118 is provided at the inner and outer ends 101 and 102, respectively, providing a mounting surface for supporting the roof slabs 18.

Figure 31A:
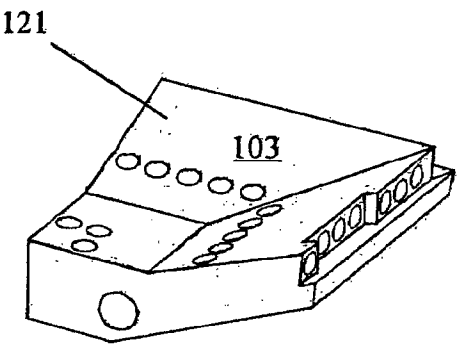
FIG. 31*a* is an isometric view of a 90° corner ceiling panel.
Figure 31B:
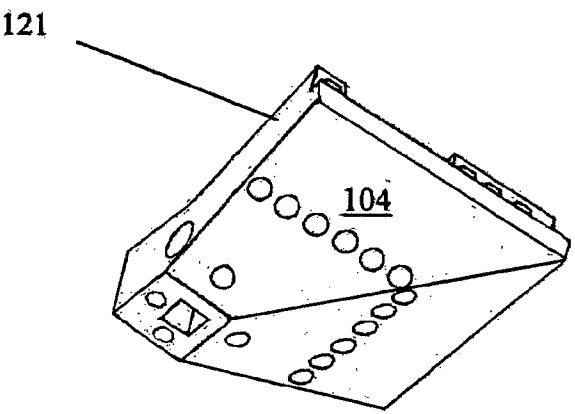
FIG. 31*b* is an isometric view of the 90° corner ceiling panel of FIG. 31*a* from below.
Figure 32A:
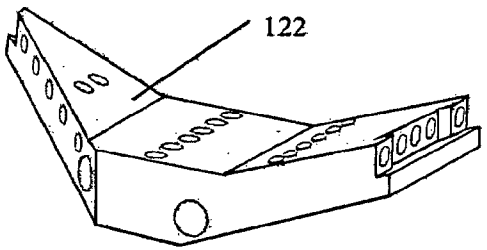
FIG. 32*a* is an isometric view of a 45° corner ceiling panel.
Figure 32B:
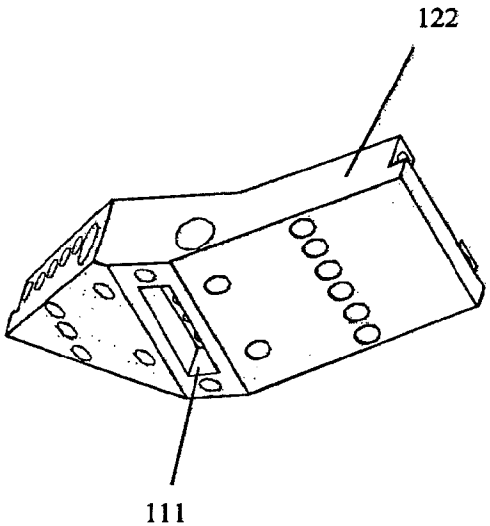
FIG. 32*b* is an isometric view of the 45° corner ceiling panel of FIG. 32*a* from below.
Figure 15B:
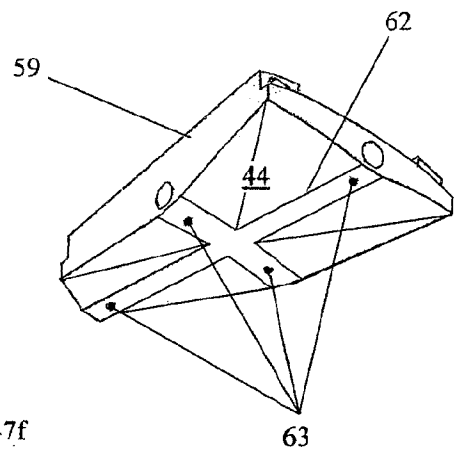
Figure 15A:
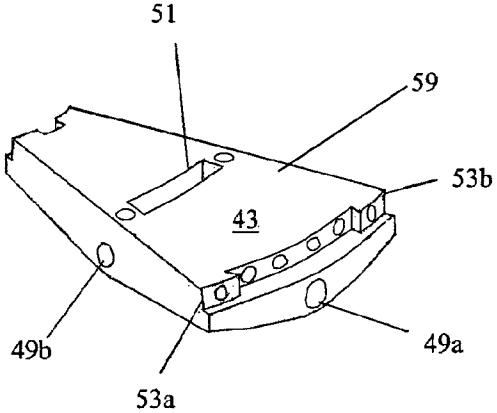
Figure 15C:
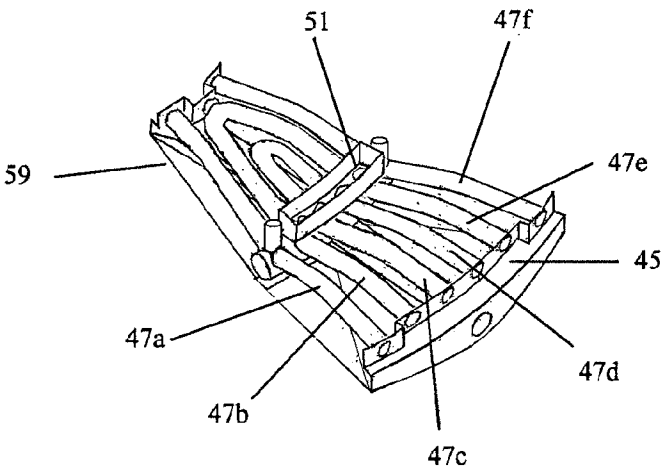
Figure 34A:
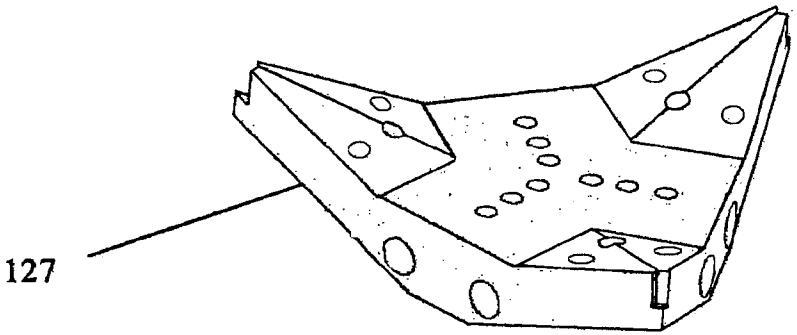
FIG. 34*a* is an isometric view of a 60° angled base panel.
Figure 34B:
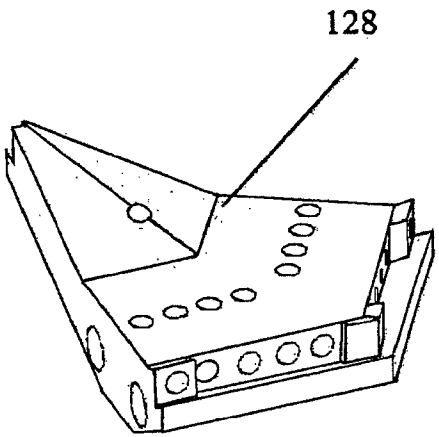
FIG. 34*b* is an isometric view of the angled base panel of FIG. 34*a* from below.
Figure 35A:
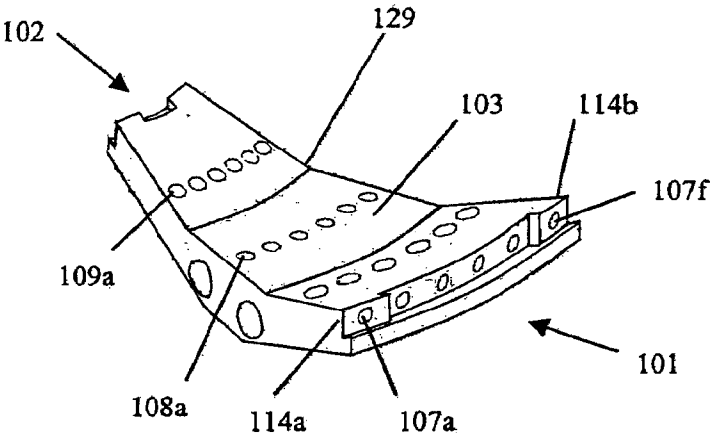
FIG. 35*a* is an isometric view of an alternative angled base panel with a rounded end.
Figure 35B:
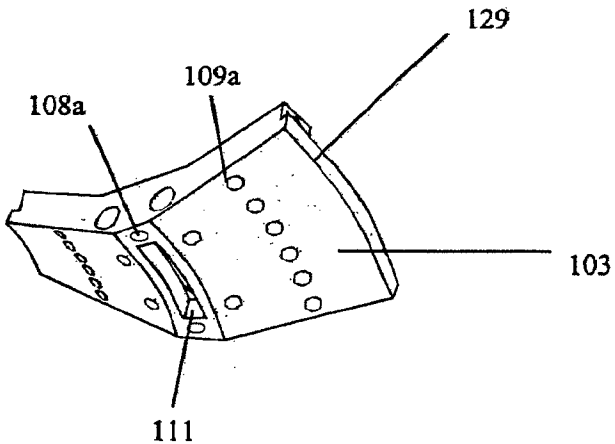
FIG. 35*b* is an isometric view of the angled base panel of FIG. 35*a* from below.

Similar to base and ceiling panels 2 and 4, respectively, a 90° corner roof panel 121 (FIGS. 31*a* and 31*b*) or two 45° corner ceiling panels 122 (FIGS. 32*a* and 32*b*) are provided for the intersection of perpendicular walls. Angled roof panels 126, 127, 128 and 129 (FIGS. 33*a*, 33*b*, 34*a*, 34*b*, 35*a* and 35*b*) are provided for rounded or non-perpendicular walls.

Figure 36:
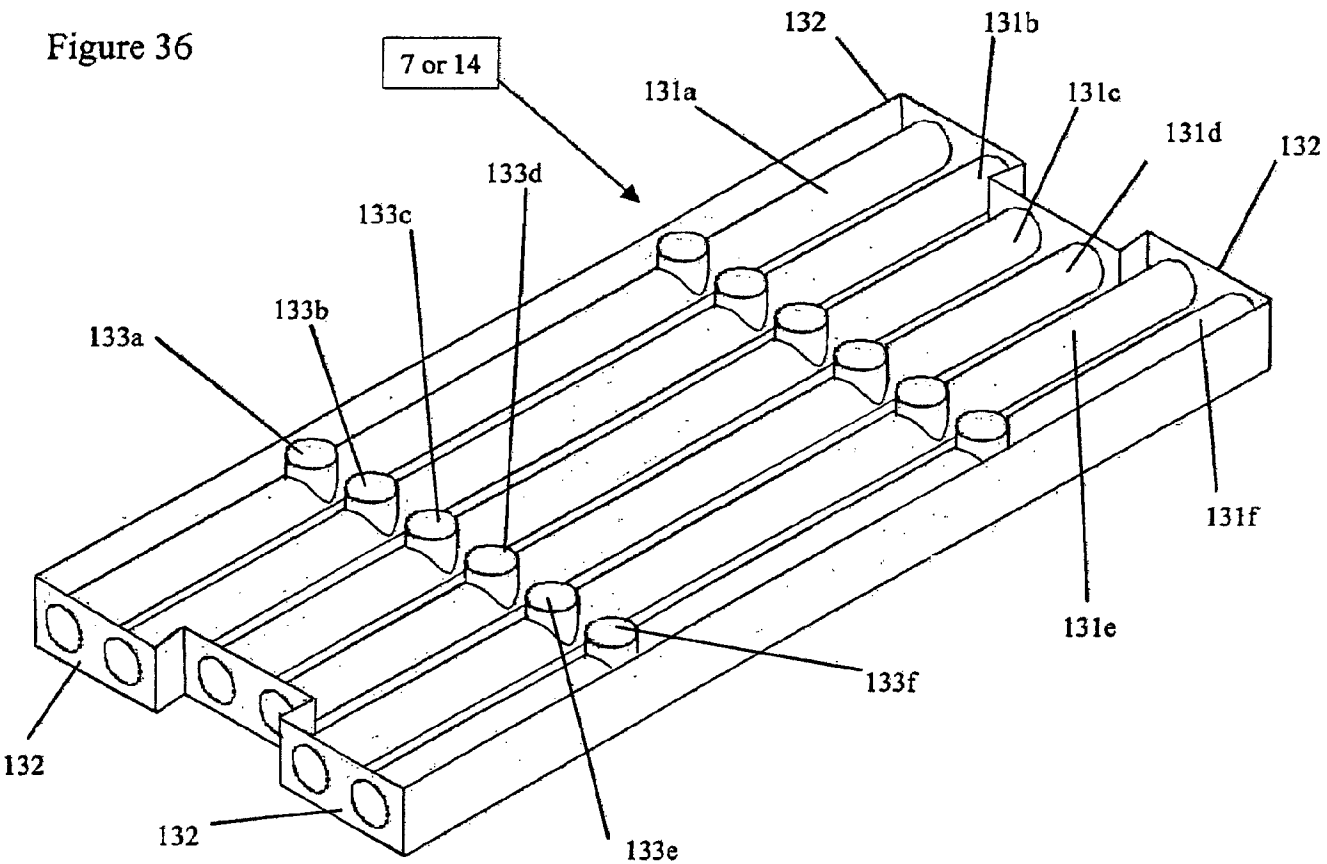
FIG. 36 is an isometric view of a ceiling/base slab panel with the outer surface removed.

Typical base or ceiling slab panels 7 and 14, illustrated in FIG. 36, include several sets of service conduits 131*a* to 131*f* for aligning with the service conduits 47*a* to 47*f* of adjacent base panels 2 or service conduits 77*a* to 77*f* of adjacent ceiling panels 4. A plurality of connector blocks 132, which act as the corresponding mating surface, extend from the sides of the slab panels 7 or 14 for engaging the inner ends 41 or 71 of the base or ceiling panels 7 or 14, respectively. The sides of the base and ceiling slab panels 7 and 14 are supported on the shoulders 45 and 75, respectively. Access conduits 133*a* to 133*f*, extending perpendicular to the service conduits 131*a* to 131*f*, are provided for access thereof.

Figure 37:
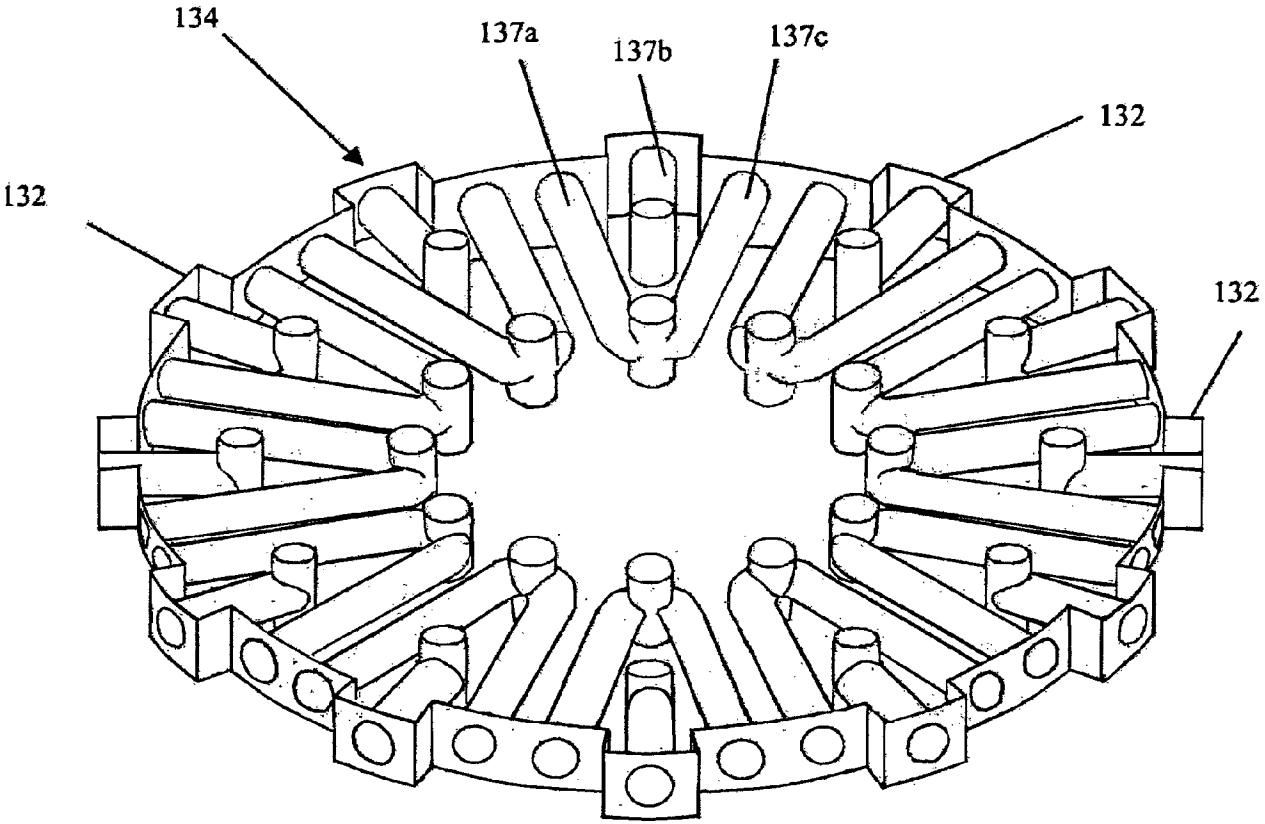
FIG. 37 is an isometric view of a circular ceiling/base slab panel with the outer surface removed.

A circular base or ceiling slab 134, illustrated in FIG. 37, includes a plurality of connector blocks 132 at various locations around the outer edge thereof for engaging the rounded base or ceiling panels 59 or 96, and for aligning the service conduits 137*a* to 137*c* with the service conduits 47*a*, 47*b* and 47*f* of adjacent base panels 2 or service conduits 77*a*, 77*b* and 77*f* of adjacent ceiling panels 4.

Figure 38:
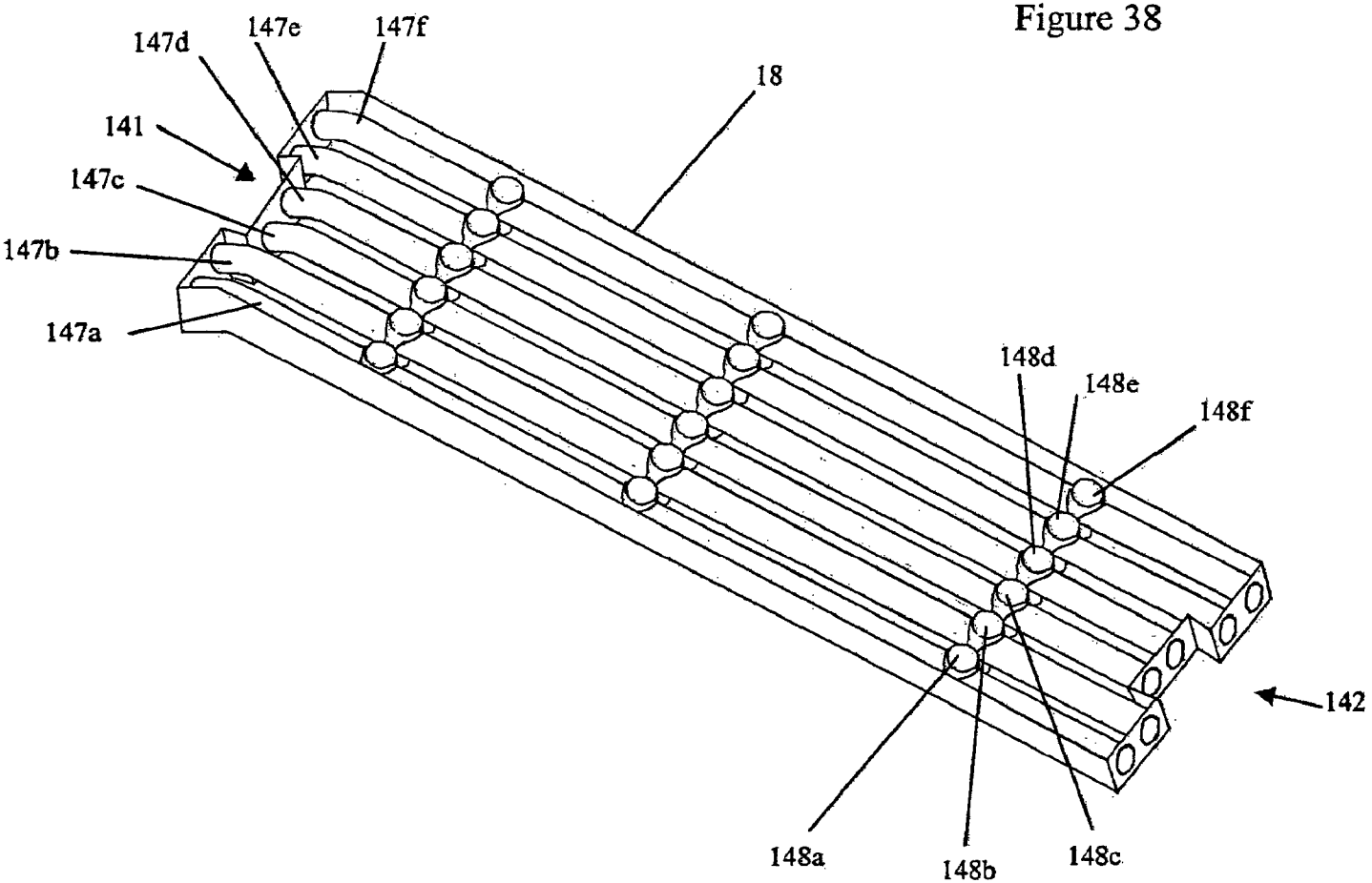
FIG. 38 is an isometric view of a roof slab panel with the outer surface removed.

With reference to FIG. 38, the roof slab panels 18 include a slightly angled inner end 141 for engaging the upwardly extending inner end 101 of the roof panels 5, an outer end 142, a top surface (not shown) and a bottom surface (not shown). Service conduits 147*a* to 147*f* extend from the inner end 141 to the outer end 142, with access conduits 148*a* to 148*f* extending therefrom to the top and/or bottom surfaces.

Figure 39:
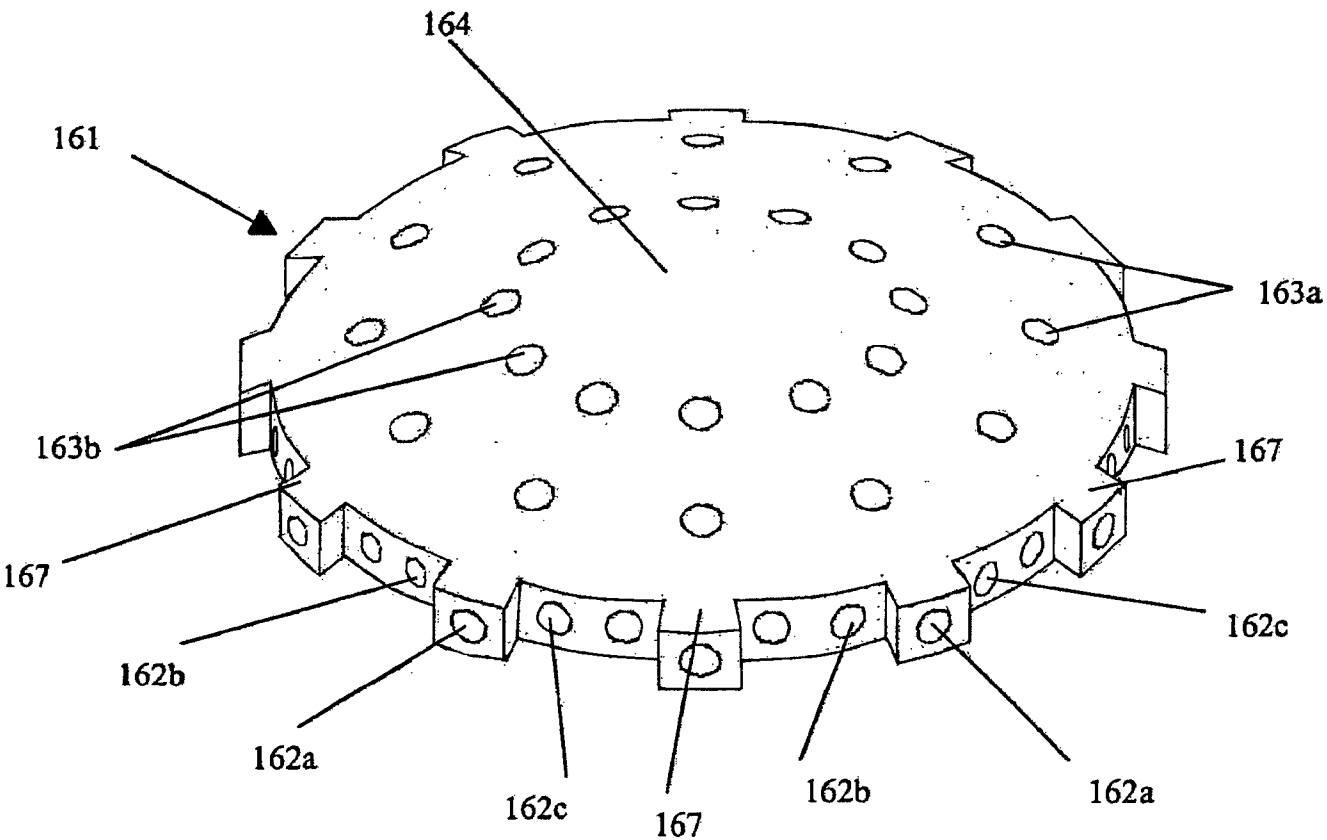
FIG. 39 is an isometric view of a domed roof slab panel.
Figure 40:
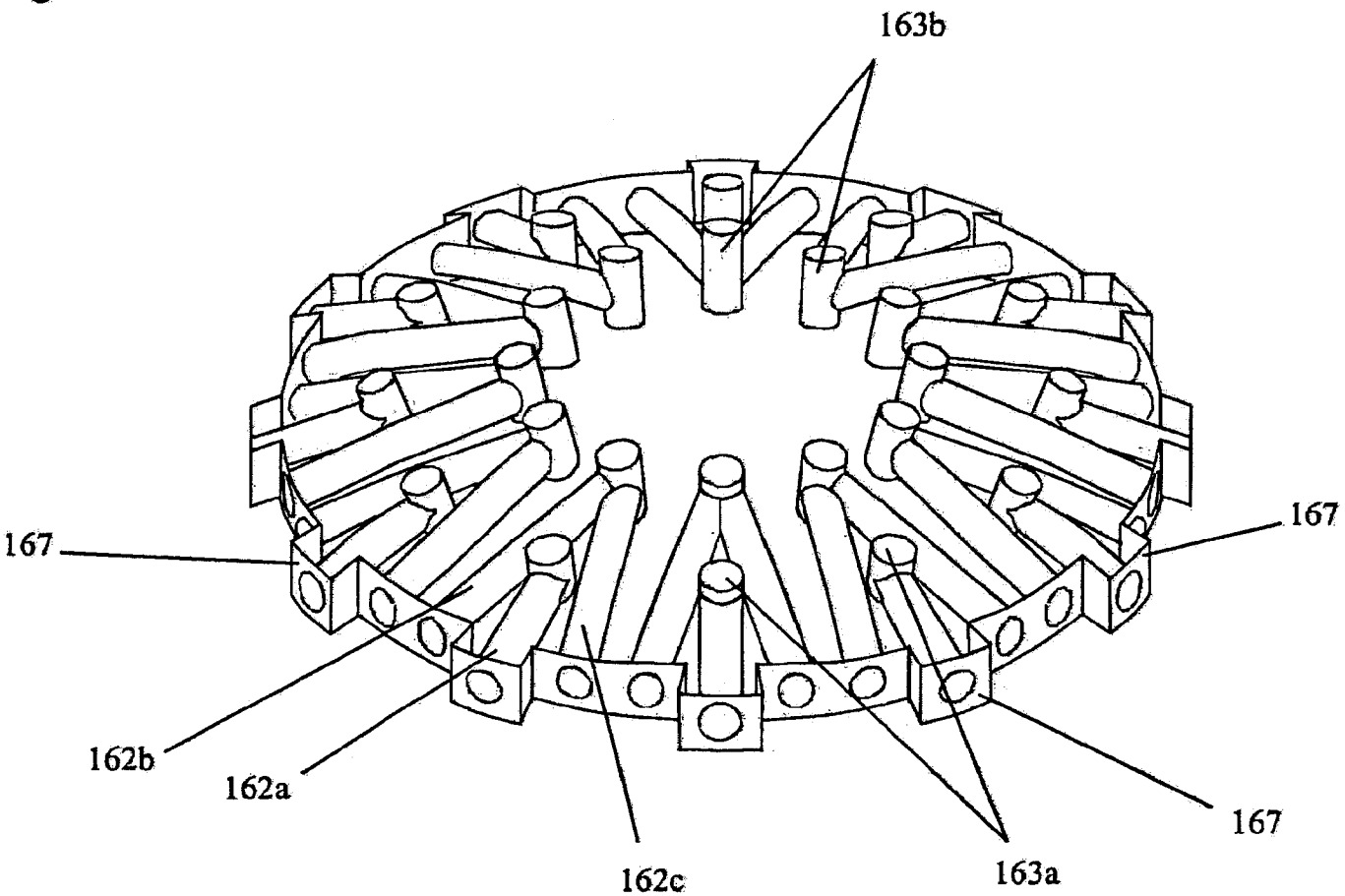
FIG. 40 is an isometric view of the domed roof slab panel of FIG. 39 with the outer surface removed.
Figure 41:
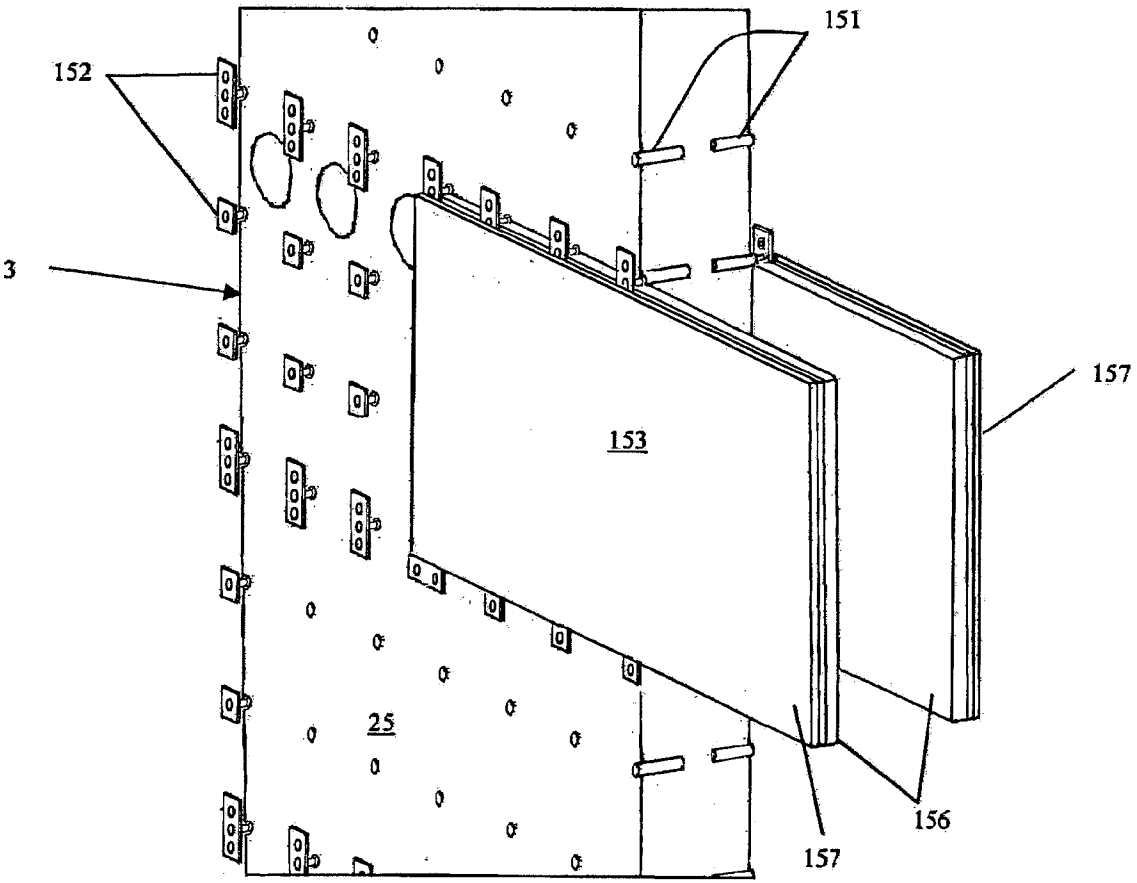
FIG. 41 is an isometric view of a wall panel with exterior and interior finishing panels.
Figure 42:
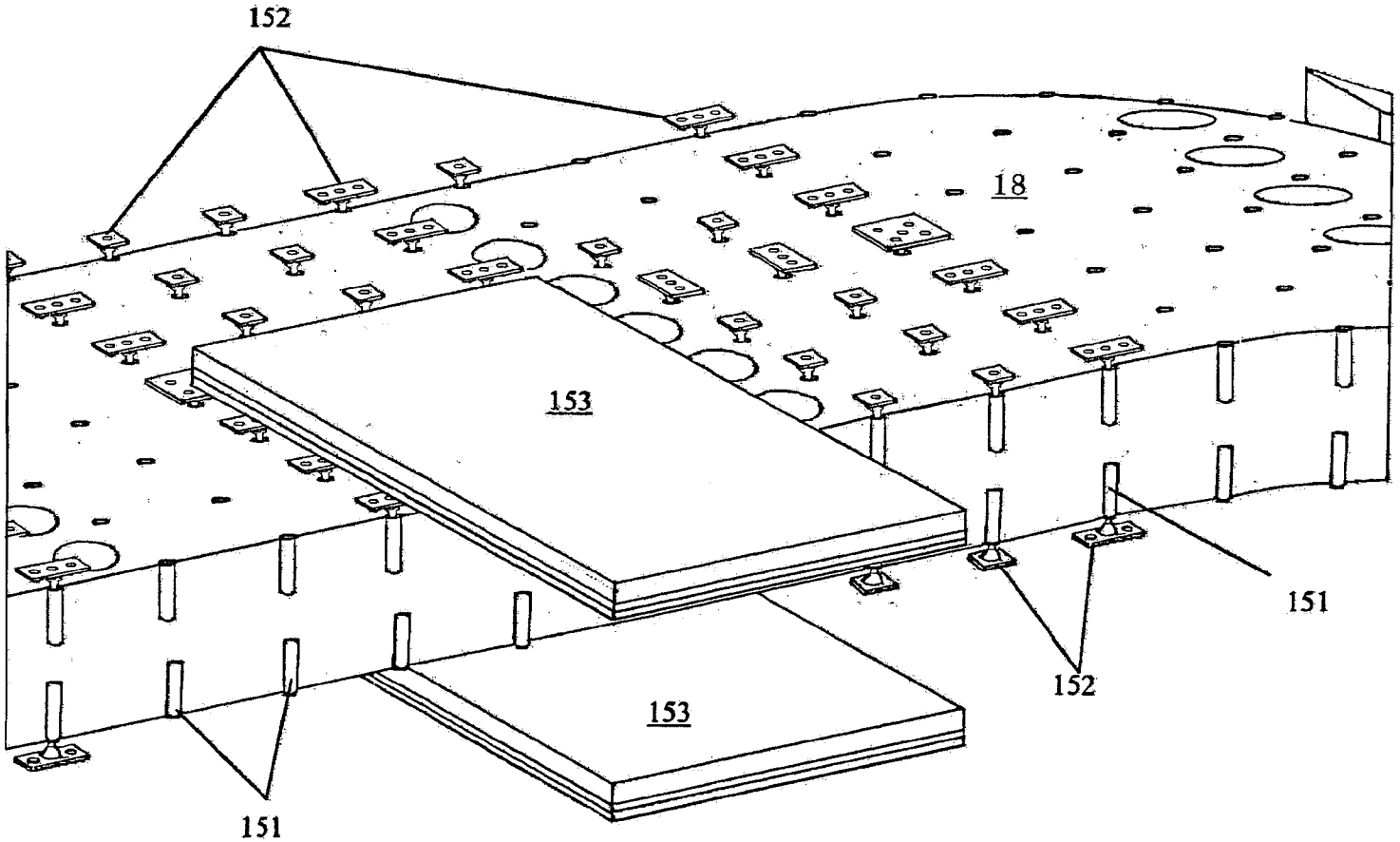
FIG. 42 is an isometric view of a ceiling panel with finishing panels.
Figure 43:
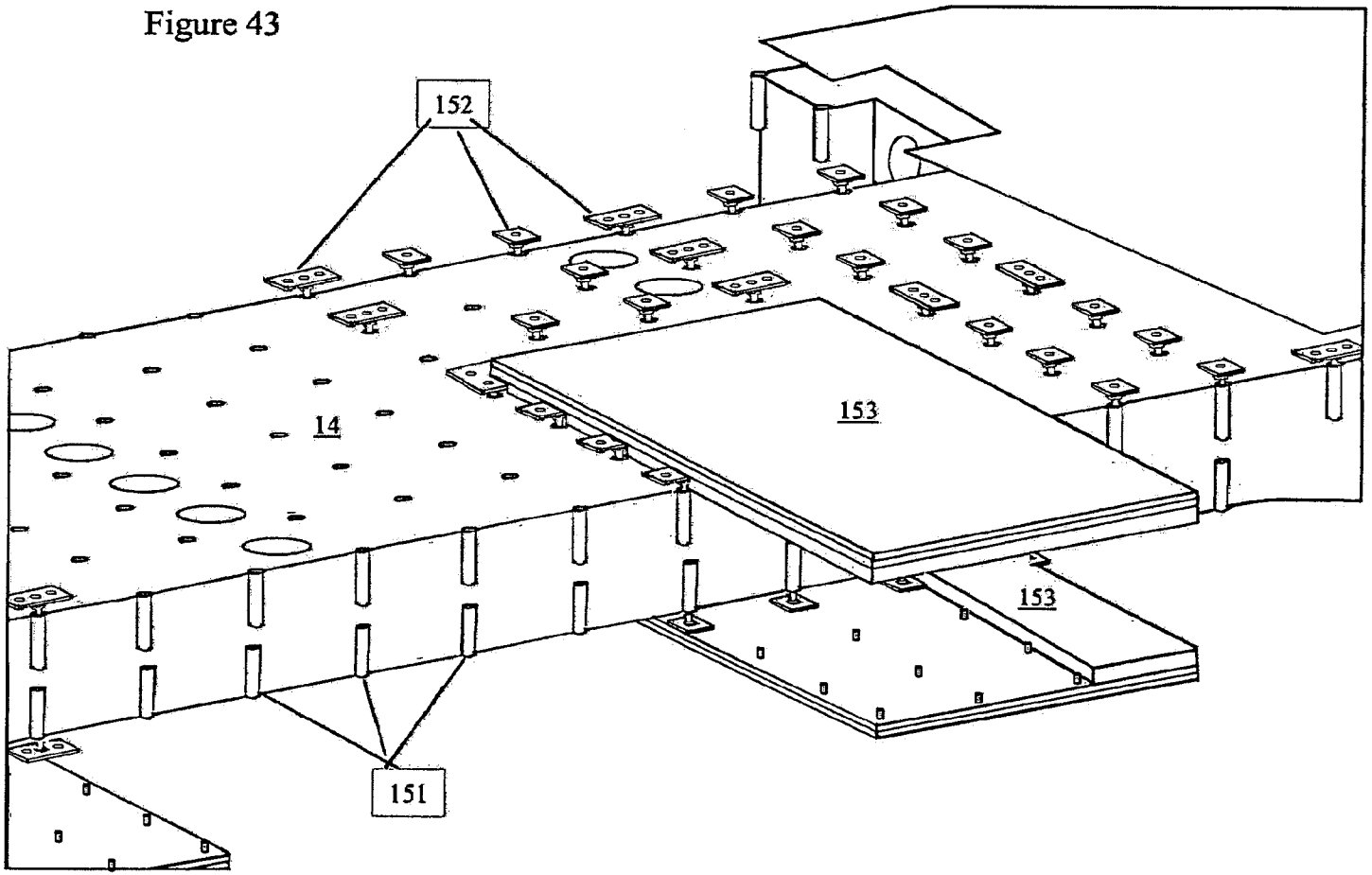
FIG. 43 is an isometric view of a roof panel with exterior and interior finishing panels.

FIGS. 39 and 40 illustrate a roof slab panel 161 in the shape of a dome for placing on the outer ends 102 of a plurality of curved roof panels 129 forming a circular roof. Forming a domed roof in-situ can be a costly undertaking; however, the present invention provides a one piece molded dome providing easy installation. A plurality of first, second and third service conduits 162*a*, 162*b*, and 162*c*, respectively, radially extend inside the domed roof slab panel 161. A first access conduit 163*a* extends from an exterior surface 164 to an interior surface (not shown) at the end of each first service conduit 162*a*. A second access conduit 163*b* extends from the exterior surface 164 to the interior surface 165 at the junction of the second and third service conduits 162*b* and 162*c*. Mating connector blocks 167 extend outwardly from around the domed roof slab panel 161 for mating with the outer ends 102 of the curved roof panels 129, and for aligning three of the service conduits therein with the service conduits 162*a* to 162*c*.

During construction of full-size structures a sealant is used to fill in the cracks between panels to prevent drafts. For miniature structures, an adhesive can be used to more strongly hold the panels together. Moreover, the block connectors 29*a*, 29*b*, 31*a*, 31*b* etc. can frictionally engage the recess connectors 51, 71, 81, 82, 111 to hold the panels together. A series of holes 151 are provided in the inner and outer surfaces of each wall, ceiling and roof panel 3, 4 and 5, respectively, for receiving wall brackets 152, which are used to secure finishing panels 153. Each finishing panel 153 includes an insulation layer 156 and a plywood layer 157. On the wall panels 3 and the lower surfaces of the roof panels 5, the roof slab panels 18, the ceiling panels 4, and the ceiling slab panels 14, the finishing panels 153 can be painted directly or can provide a supporting surface for other materials, such as plaster, drywall, ceramic etc. On the exterior surface 25 of the wall panels 3, the finishing panels 153 serve as a supporting surface for external wall covers, such as siding, brick etc. For the upper surfaces of base panels 2, the base slab panels 7, the ceiling panels 4, and the ceiling slab panels 14, the finishing panels 153 provide a mounting surface for floor covering, such as ceramic tile, hardwood floors, carpeting etc.

Figure 44:
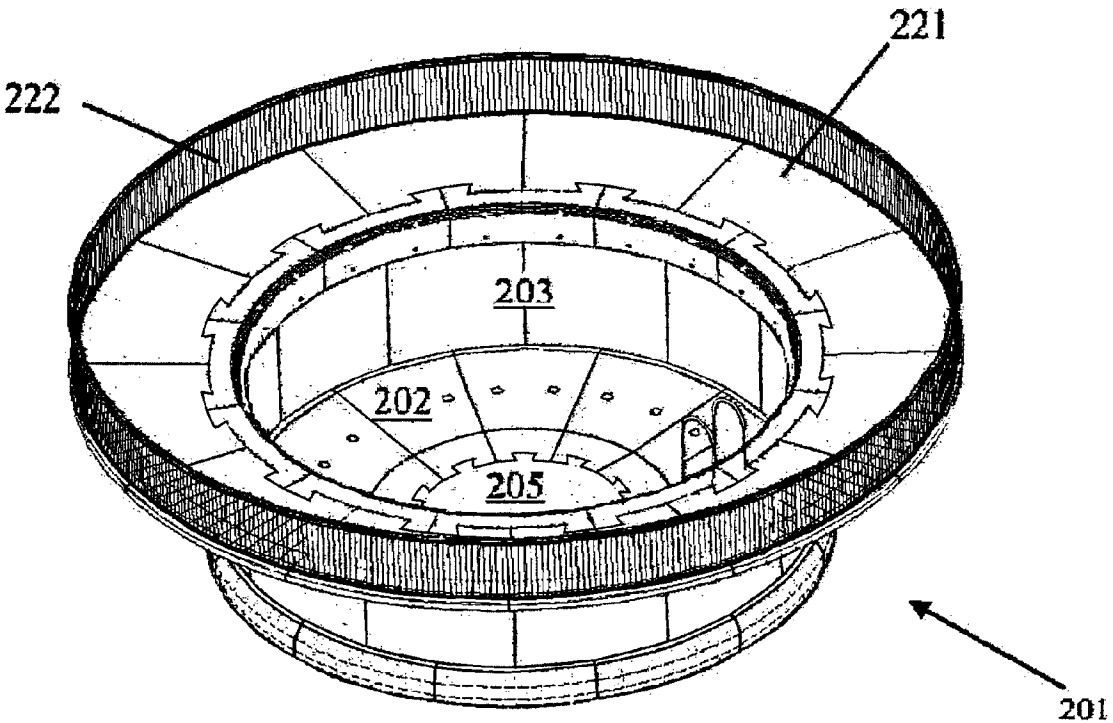
FIG. 44 is an isometric view of a swimming pool according to the present invention.
Figure 45:
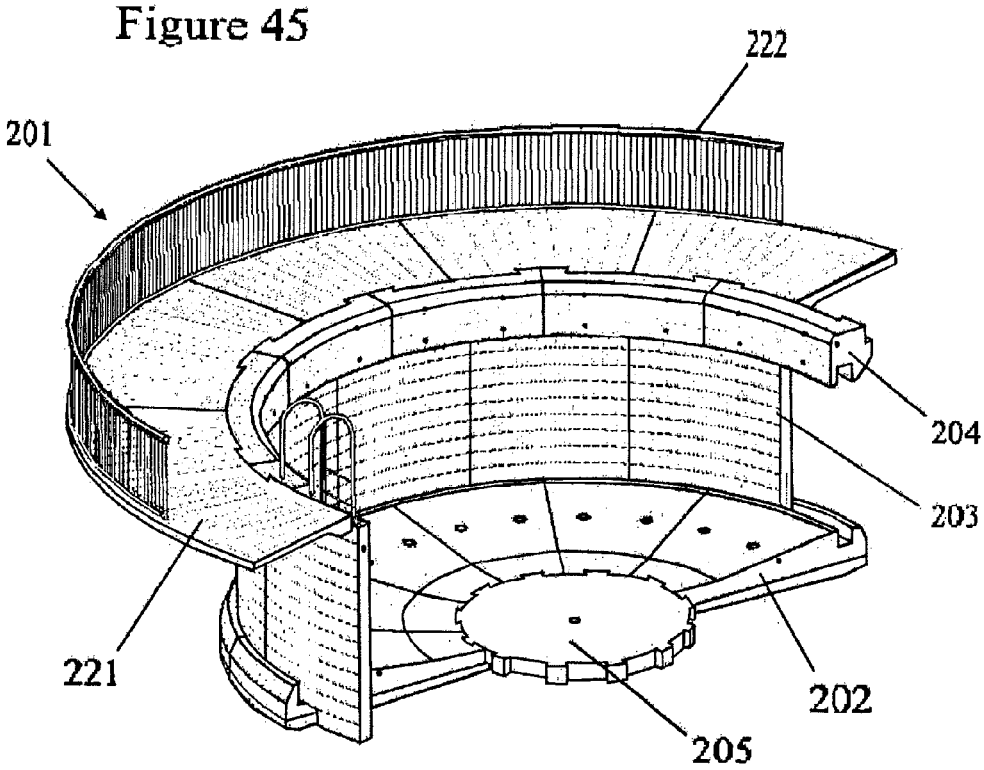
FIG. 45 is a cross-sectional view of the swimming pool of FIG. 44.
Figure 46:
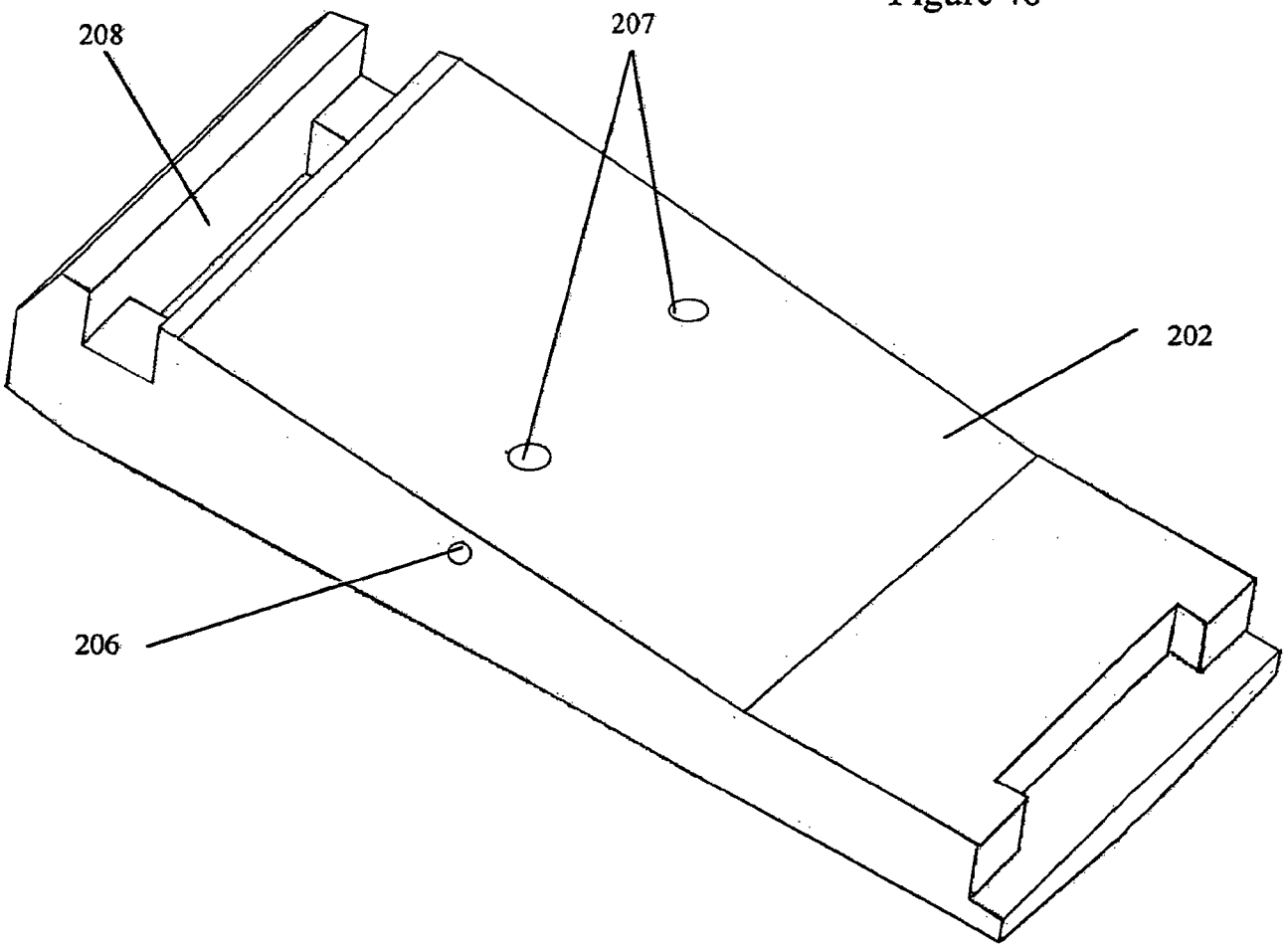
FIG. 46 is an isometric view of a base panel for the swimming pool of FIG. 44.
Figure 47:
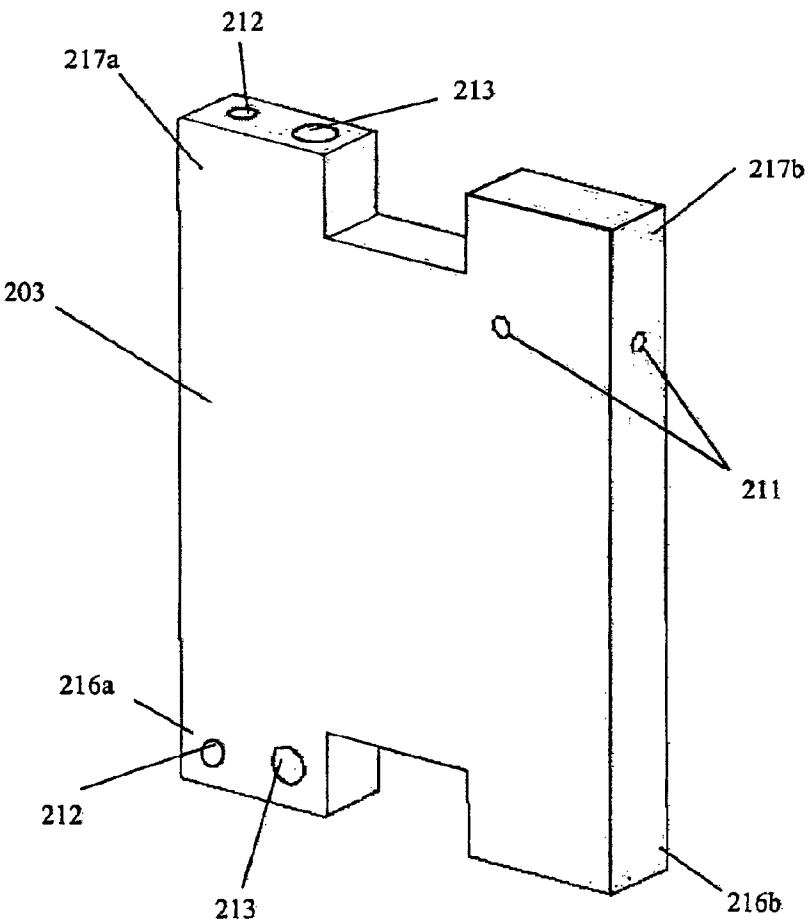
Figure 48:
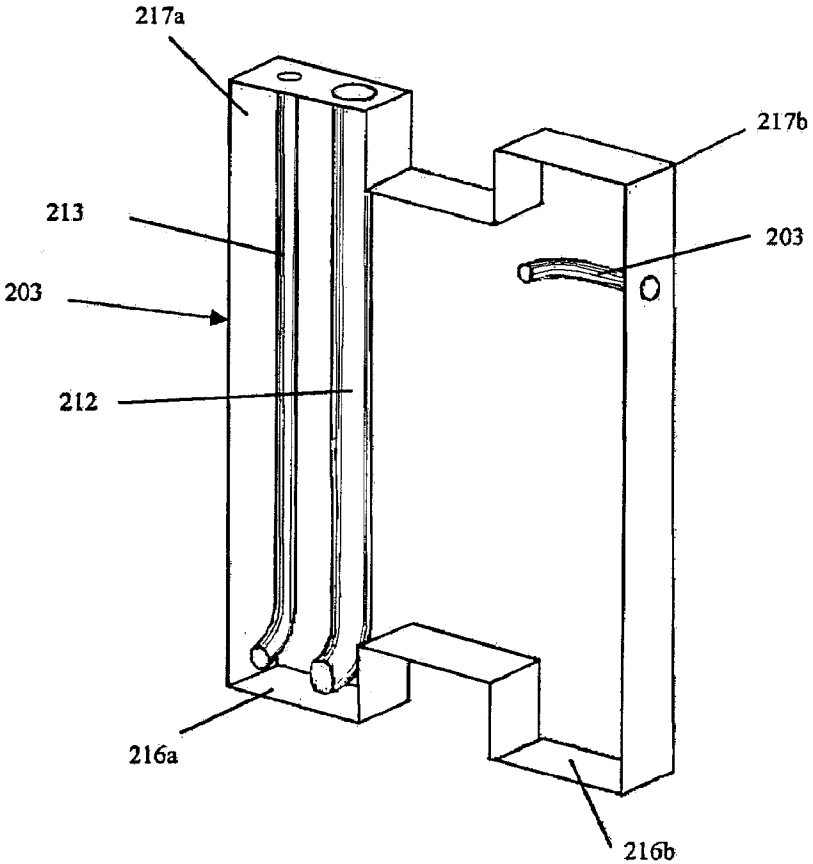
FIG. 48 is an isometric view of the wall panel of FIG. 45 with the outer surface removed.

Specialized structures, such as swimming pool 201 (FIG. 44), can also be constructed utilizing the modular building system according to the present invention. The swimming pool 201 is constructed from a plurality of triangular shaped base panels 202 (FIG. 46), a plurality of H-shaped wall panels 203 (FIG. 47), and a plurality of upper shoulder panels 204. The base of the swimming pool 201 also includes a circular slab panel 205. The base panels 202 include at least one service conduit 206, for electrical service, extending thereacross with access conduits 207 extending upwardly to an upper surface thereof. A connector recess 208 is provided in the wide end of the base panels 202 for receiving the wall panels 203. At least one of the wall panels 203 includes a first service conduit 211 for water extending thereacross, and second and third service conduits 212 and 213 extending downwardly therethrough for water drainage, and electrical, respectively. The rest of the wall panels 203 require only the first service conduit 211 for return water. Each wall panel 203 includes a lower connector foot 216*a* and 216*b* for mating with the base panels 202, and upper connector foot 217*a* and 217*b* for mating with the shoulder panels 204. As above, the lower connector foot 216*a* mates with one base panel 202, while the lower connector foot 216*b* mates with an adjacent base panel 202.

Figure 49:
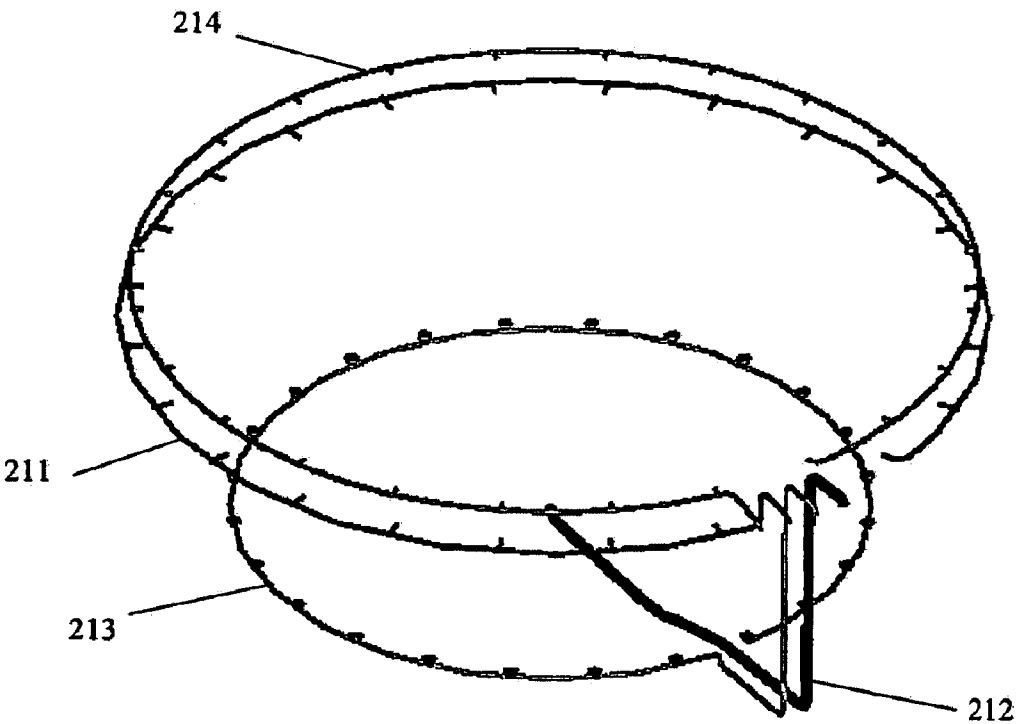
FIG. 49 is an isometric view of the service conduit system for the swimming pool of FIG. 42.

FIG. 49 illustrates the service conduit system including the first service conduit 211 for water input, which encircles the top rim of the pool 201, the second service conduit 212 for water drainage, which is a single output pipe, the third service conduit for electrical wiring 213, which encircles the base of the pool, and the fourth service conduit 214, which encircles the top rim of the pool 201, for water overflow. Deck panels 221 with a railing 222 can also be provided for safety reasons.

Figure 50:
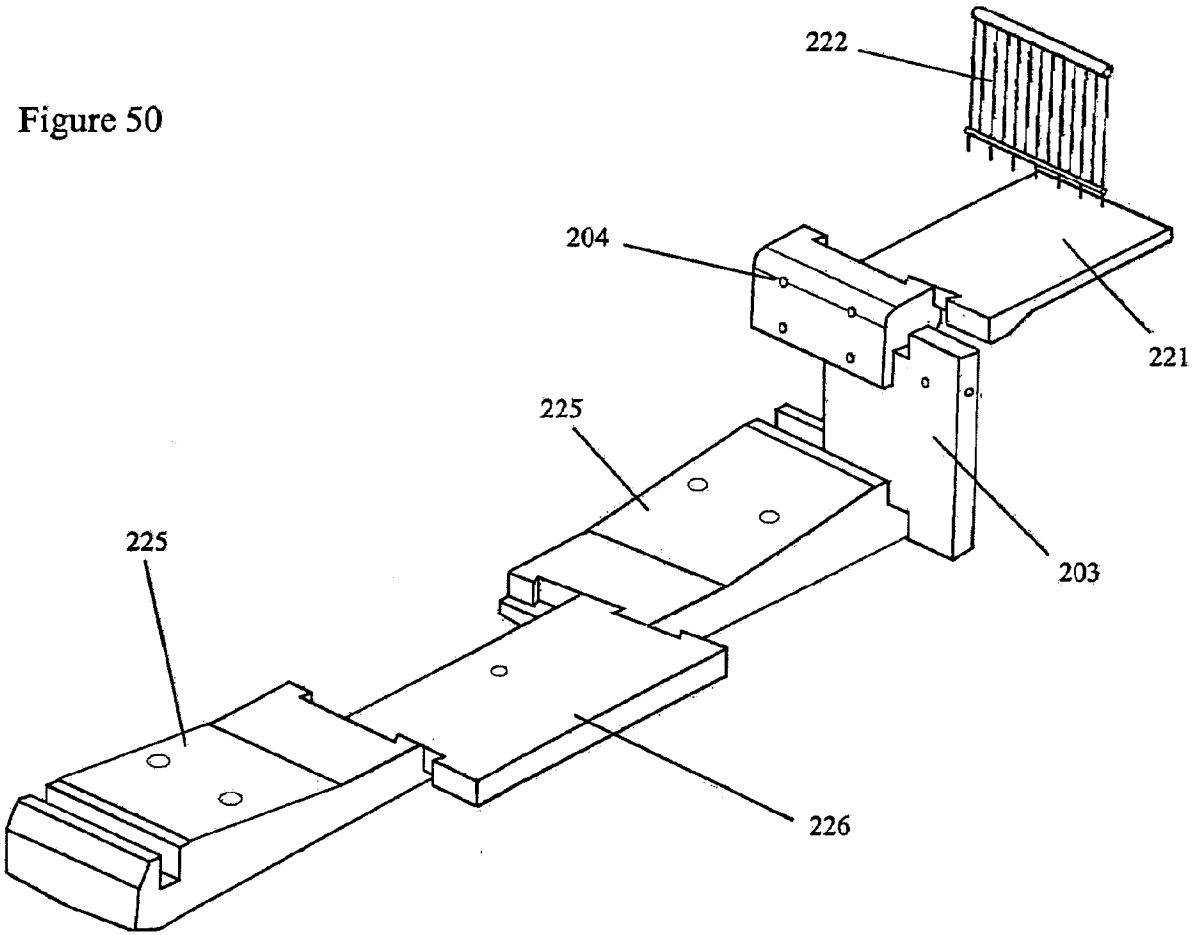
FIG. 50 is a partial assembly drawing of a rectangular swimming pool.
Figure 51:
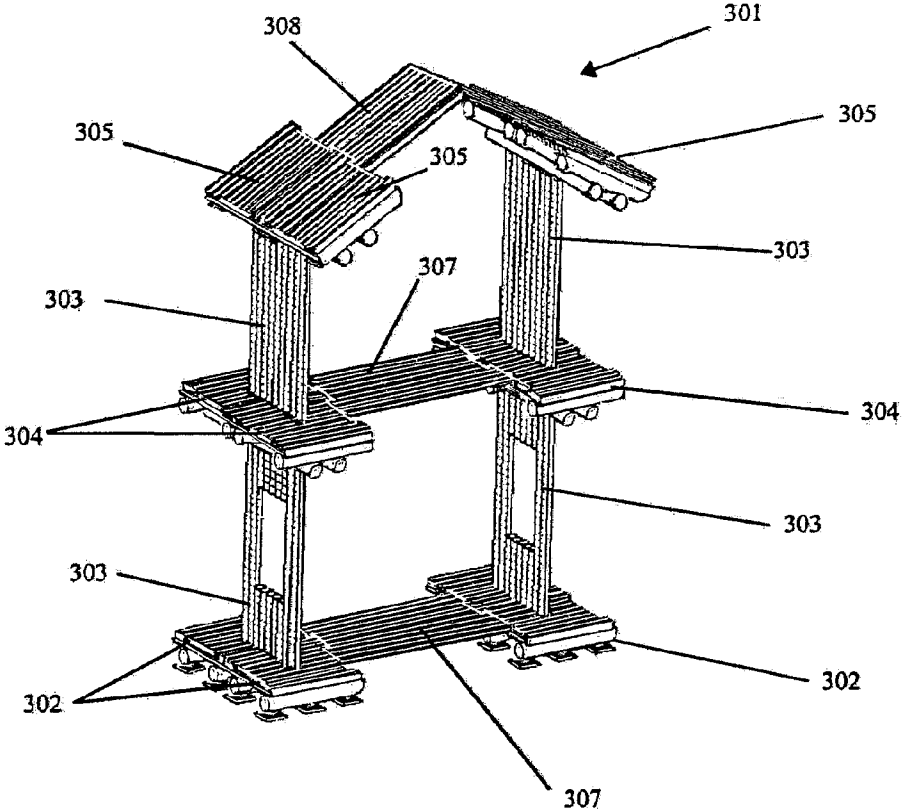
FIG. 51 is an isometric view of a partial building according to another embodiment of the present invention constructed of logs.

A rectangular or oval pool, partially illustrated in FIG. 50, includes rectangular base panels 225 with rectangular slab panels 226 in the overlapping arrangement, as discussed above. The wall panels 203 interlock with the base panels 225 in the overlapping arrangement, as well. Upper shoulder panels 204 are also provide with deck panels 221 and railings 222 extending therefrom.

FIGS. 51 to 57 illustrate an alternative embodiment of the present invention in which the panels are constructed out of logs. A log building 301 includes log base panels 302, log wall panels 303, log ceiling panels 304, and log roof panels 305. Log/ceiling slab panels 307 extend between the log or ceiling panels 302 or 304, while roof slab panels 308 extend between roof panels 305.

Figure 52:
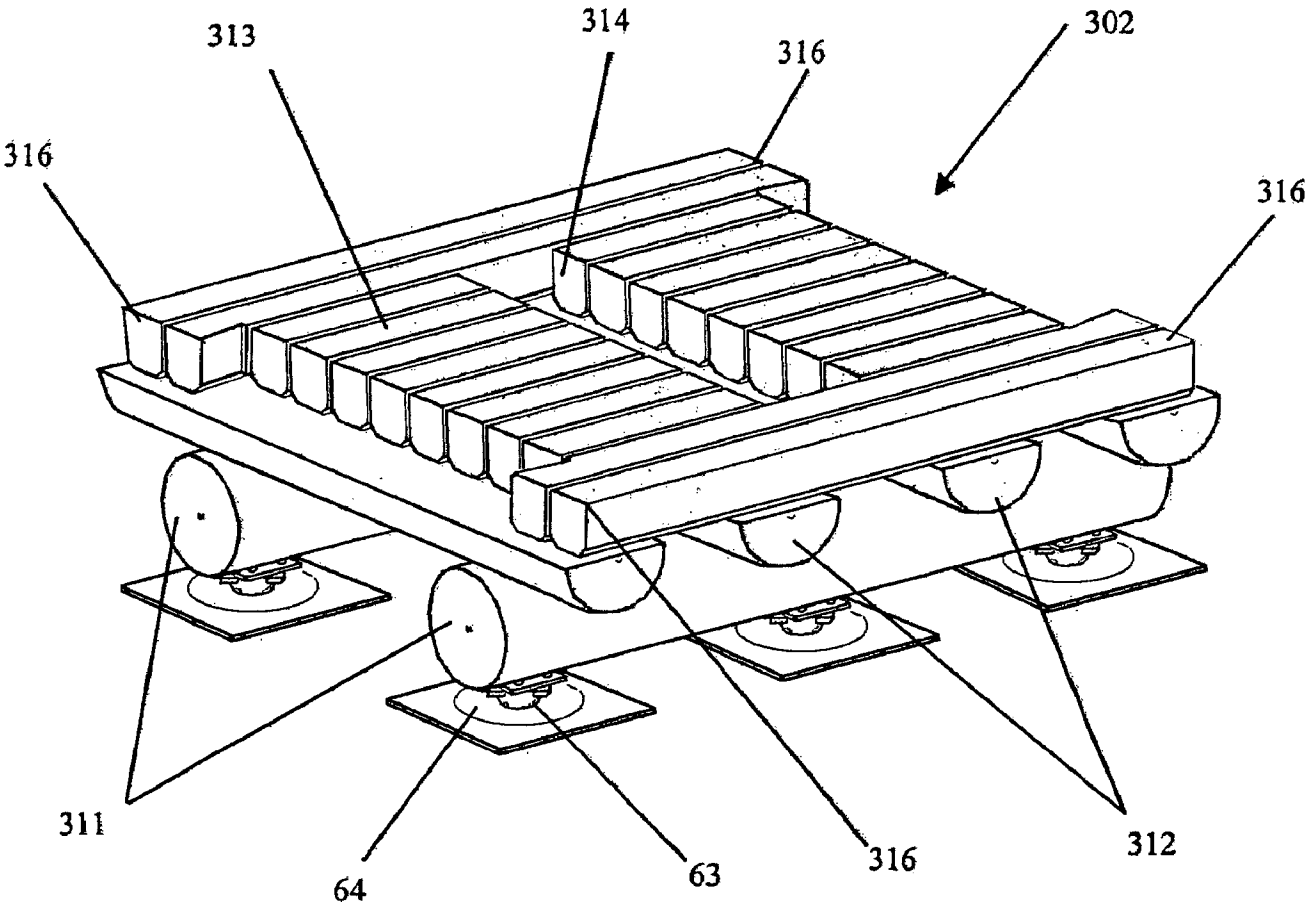
FIG. 52 is an isometric view of a log base panel of the building of FIG. 51.
Figure 53:
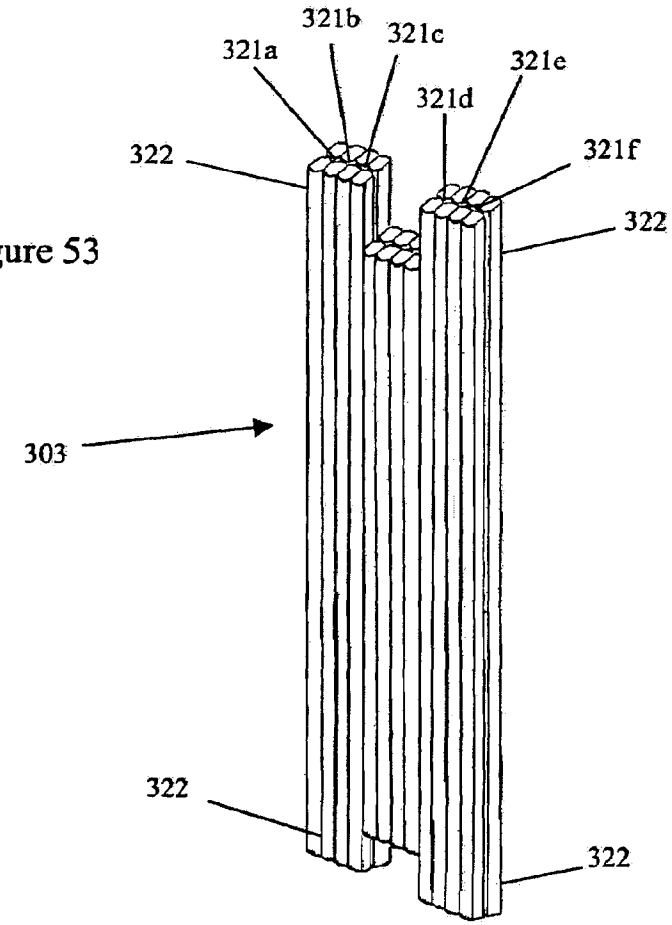
FIG. 53 is an isometric view of a log wall panel of the building of FIG. 51.
Figure 54:
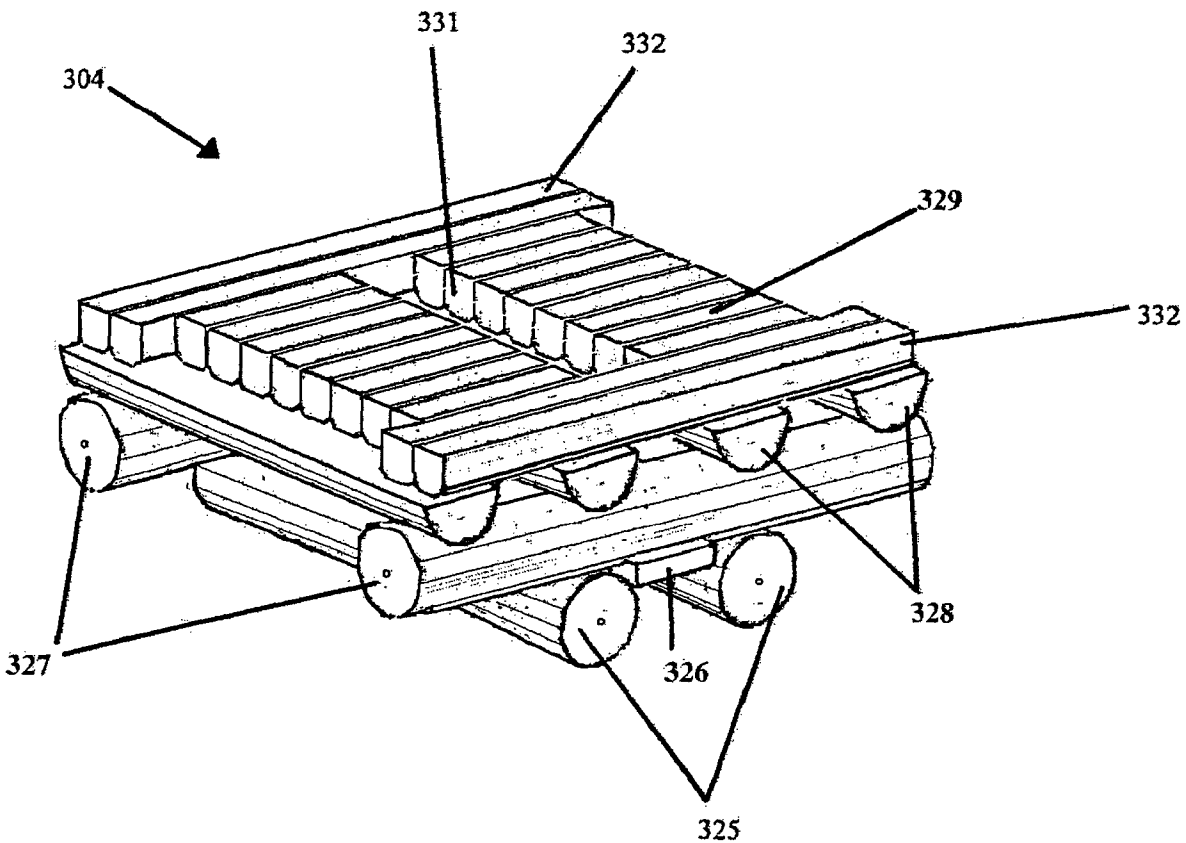
FIG. 54 is an isometric view of a log ceiling panel of the building of FIG. 51.
Figure 55:
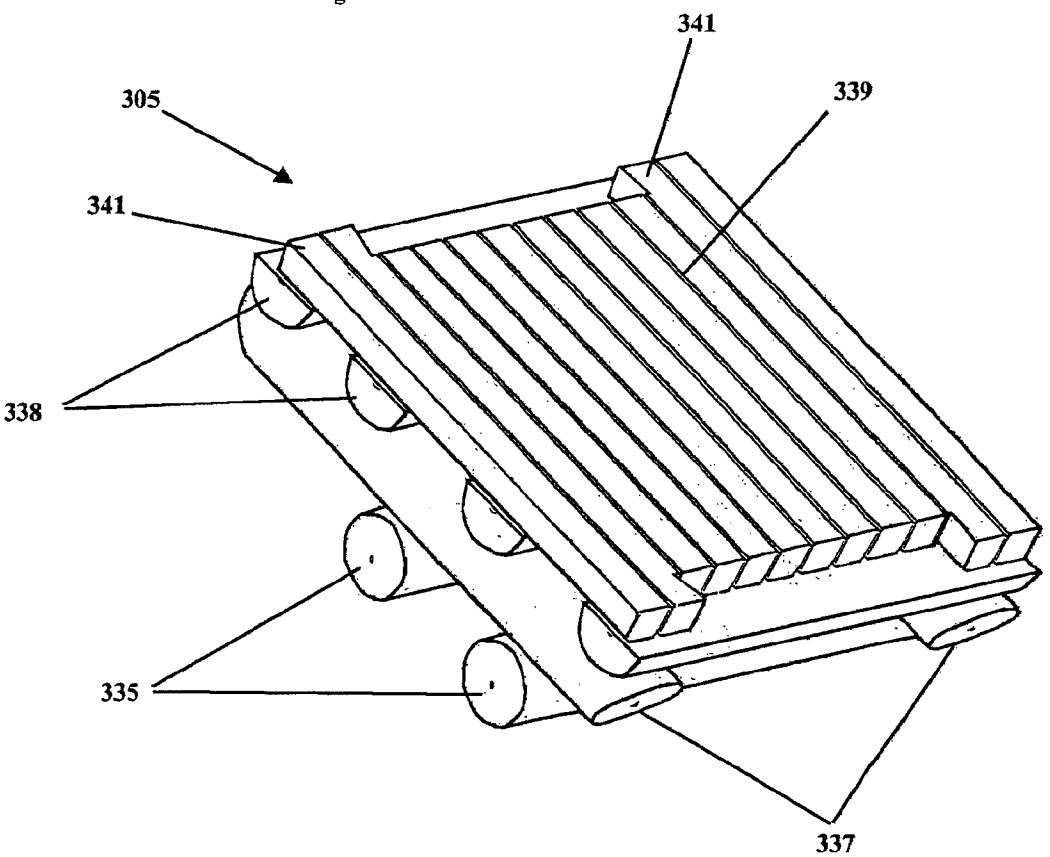
FIG. 55 is an isometric view of a log roof panel of the building of FIG. 51
Figure 56:
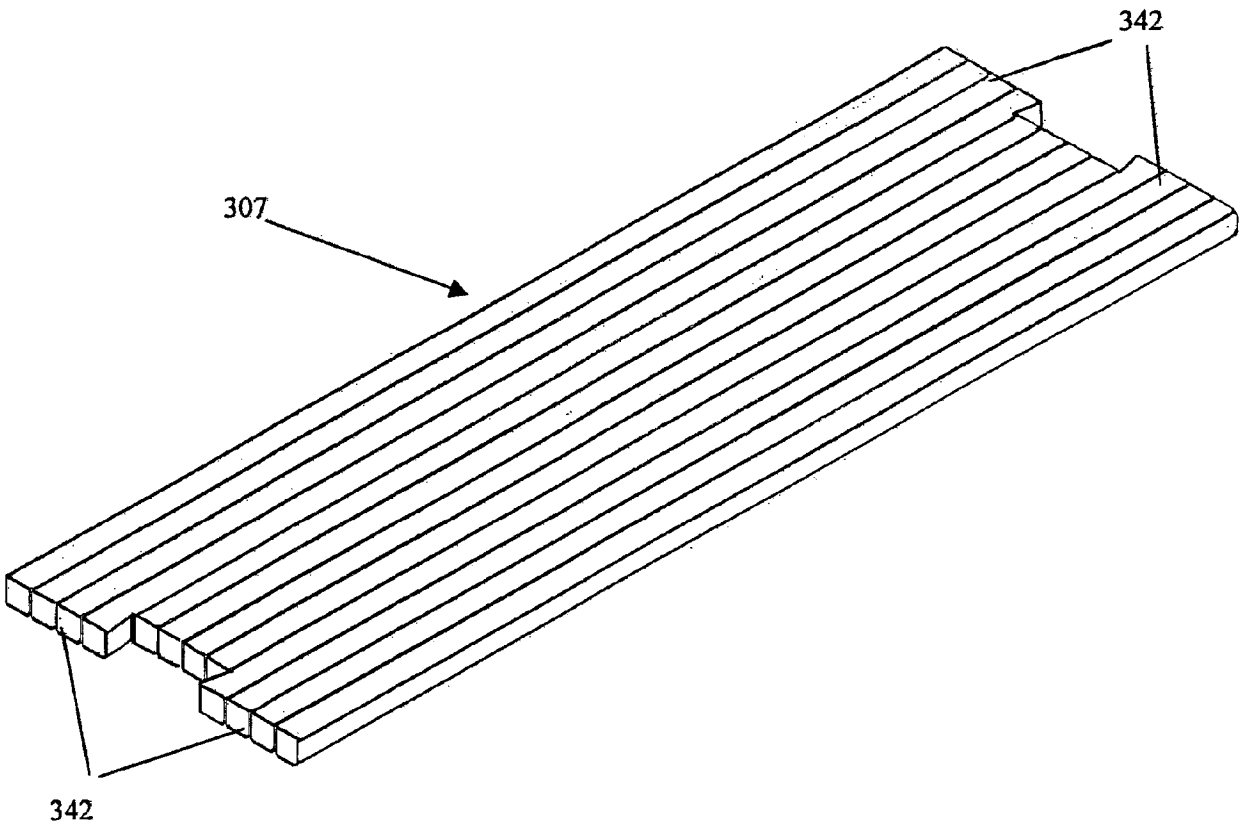
FIG. 56 is an isometric view of a log base or ceiling slab panel of the building of FIG. 51.
Figure 57:
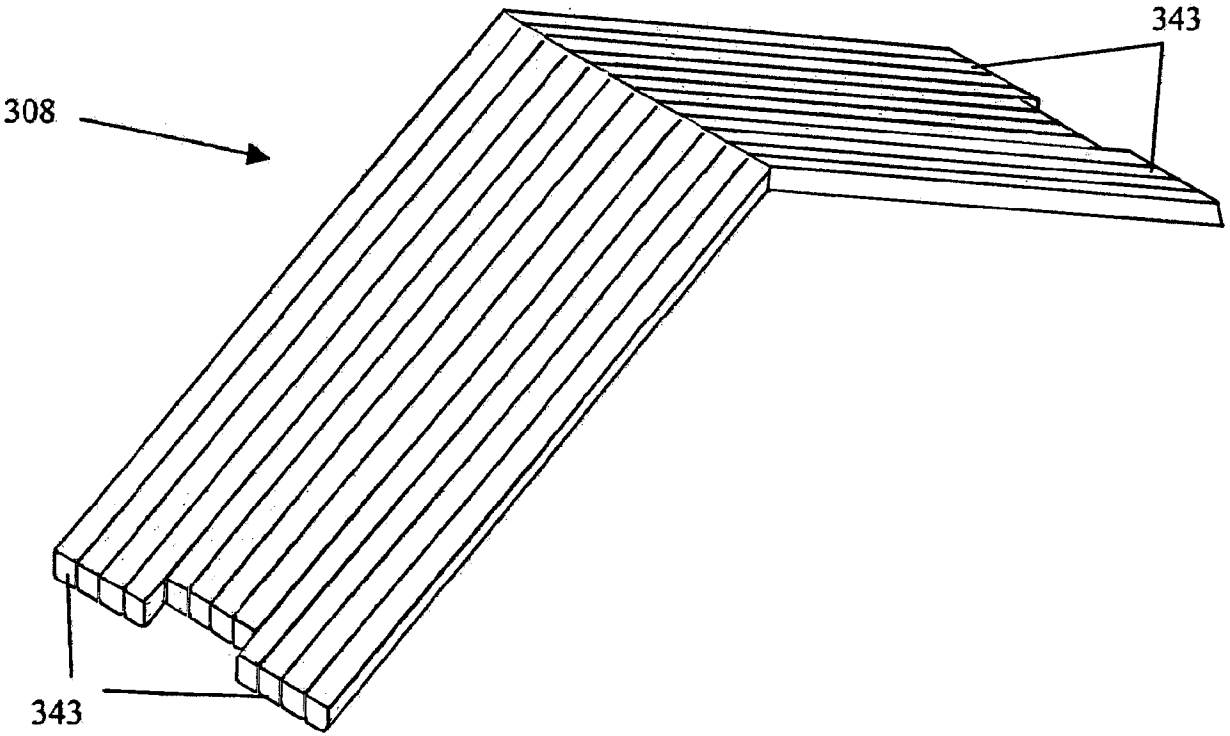
FIG. 57 is an isometric view of a log roof slab panel of the building of FIG. 51.

As illustrated in FIG. 52, the log base panel 302 includes two full logs 311 for the lower mounting layer, four half logs 312 for the middle support layer, and an upper finished wood layer 313. A female connector recess 314 is provided in the upper finished wood layer 313 for receiving the log base panels 302. Connector blocks 316 extend from each end of the log base panel 302 for interconnecting with the log slab panels 307. Preferably, bearing plates 64 are provided on the footings for receiving the domed-shaped bearings 63 extending from the logs of the lower mounting layer 311, for reasons defined above. Service conduits are formed between the logs in the various layers wherever required. Access conduits are cut or formed through the sides of the panel wherever required.

The log wall panels 311 include two layers of nine circular logs each connected together defining service conduits 321*a* to 321*f* in between each grouping of four logs connected together. Connector blocks 322 extend from each end of the log wall panel for interlocking with the base, ceiling and roof panels 302, 304 and 305, respectively.

The log ceiling panel 304 includes a bottom layer of logs 325 defining a first female connector 326 for receiving the connector blocks 322 from a pair of log wall panels 311 making up a lower wall. An intermediate layer of logs 327, perpendicular to the bottom layer 325, is provided along with a layer of half logs 328 mounted thereacross. The half log layer 328 provides a flat base for the finishing log layer 329, which also defines a second female connector 331 for receiving the connector blocks 322 from a pair of log wall panels 311 making up an upper wall. Connector blocks 332 extend from the ends of the log ceiling panel 304 for mating with a pair of adjacent ceiling slab panels 307. Each ceiling slab panel 307 (FIG. 56) includes connector blocks 342 extending therefrom for mating with a pair of adjacent log ceiling panels 304, and each roof slab panel 308 (FIG. 57) includes connector blocks 343 extending therefrom for mating with a pair of adjacent log roof panels 305. Service conduits are formed between the logs in the various layers wherever required. Access conduits are cut or formed through the sides of the panel wherever required. The ceiling and roof slab panels 307 and 308 may also be constructed of two layers of logs, similar to the wall panels 303 providing service conduits between each grouping of logs.

Similarly, the roof panel 305 includes a bottom layer of logs 335, defining a first female connector 336 for receiving the connector blocks 322 from a pair of wall panels 302, and an intermediate layer of logs 337, with an additional layer of half logs 338 mounted thereacross. As above, the half-log layer 338 provides a base for a finishing log layer 339. Connector blocks 341 extend from the ends of the finishing log layer 339 for mating with a pair of adjacent roof slab panels 308. Service conduits are formed between the logs in the various layers wherever required. Access conduits are cut or formed through the sides of the panel wherever required.

I claim:

1. A modular construction system for a full-size or miniature structure comprising a plurality of interlocking panels, each panel including:

a plurality of parallel service conduits extending longitudinally therethrough;

a plurality of access conduits extending laterally therein for accessing the service conduits; and connectors for interlocking adjacent panels and for aligning the service conduits of adjacent panels;

wherein the plurality of interlocking panels includes:

base panels, each base panel including:

first and second ends;

top and bottom surfaces;

a first connector recess in the top surface for receiving a first connector block of a first perpendicular wall panel and for receiving a second connector block of a second perpendicular wall panel, and for aligning at least one service conduit of each of the first and second wall panels with service conduits of the base panel extending into the first connector recess; and a first mating surface at the first or second end thereof for mating with adjacent base panels, and for aligning the service conduits with service conduits, respectively, in adjacent base panels.

2. The system according to claim 1, wherein the first mating surface includes:

a shoulder providing a mounting surface for supporting ends of inner base slab panels; and connector blocks for interlocking and aligning with corresponding mating surfaces on the inner base slab panels.

3. The system according to claim 2, wherein the plurality of panels includes a plurality of roof panels, each roof panel including:

first and second ends;

interior and exterior surfaces;

third connectors on the interior surface for mating with the first connector of at least one perpendicular wall panel, and for aligning at least one service conduit of each wall panel with access conduits of the roof panel; and a second mating surface at the first and/or the second ends thereof for connecting with adjacent roof panels, and for aligning the service conduits with the service conduits in the adjacent roof panels.

4. The system according to claim 3, wherein the plurality of panels includes a plurality of ceiling panels, each ceiling panel including:

first and second ends;

upper and lower surfaces;

a fourth and a fifth connector on the upper and lower surfaces, respectively, for mating with the first connectors of at least one wall panel, extending upwardly and downwardly therefrom, and for aligning at least one service conduit of each wall panel with access conduits of the ceiling panels; and a third mating surface at the first and/or the second ends thereof for connecting with adjacent ceiling panels, and for aligning the service conduits with the service conduits in adjacent ceiling panels.

5. The system according to claim 2, wherein the first connector on the base panels comprises first and second female connectors for receiving a first male connector from one wall panel and a second male connector from another wall panel, whereby two wall panels overlap one base panel.

6. The system according to claim 5, wherein at least one access conduit of each base panel extends to the first female connector for aligning with the at least one service conduit in the first male connector of one wall panel, and at least one access conduit extends to the second female connector for aligning with the at least one service conduit in the second male connector of another wall panel.

7. The system according to claim 4, wherein each access conduit of the wall and ceiling panels extends from the service conduits to the front and back surfaces, and to the upper and lower surfaces respectively, thereof.

8. The system according to claim 2, wherein each base panel further comprises a lateral conduit extending perpendicular to the service and access conduits to at least one side thereof.

9. The system according to claim 8, wherein the lateral conduit is at a different level than the service conduits, and is connected to at least one of the service conduits.

10. The system according to claim 2, wherein each base panel further comprises a plurality of first bearing surfaces for engaging a plurality of second bearing surfaces on a footing below each base panel to provide relative movement between each base panel and the footing during earthquakes; and wherein each of the first bearing surfaces comprises a domed shaped bearing extending from the bottom surface for mating with an inverted dome shaped bearing plate positioned on the footing;

whereby the dome-shaped bearing will return to a normal position in the inverted dome shaped bearing plate after relative movement therebetween.

11. The system according to claim 2, wherein the plurality of panels includes angled base panels, each angled base panel having sides joined with an acute angle therebetween.

12. The system according to claim 11, further comprising a plurality of second connectors on the top surface of the angled base panels for mating with the first connectors on a plurality of wall panels.

13. The system according to claim 12, wherein the service conduits in the angled base panels extend between the plurality of second connectors.

14. The system according to claim 11, wherein a plurality of angled base panels forms the base for a structure with more than four sides.

15. The system according to claim 4, wherein the plurality of panels further includes inner ceiling panels, each inner ceiling panel including fourth mating surfaces for mating with the third mating surfaces on the ceiling panels; and wherein the third and fourth connectors are disposed proximate the middle of each ceiling panel, whereby portions of each ceiling panel extend outwardly from the wall panels forming cantilevered arms for supporting the inner ceiling panels.

16. The system according to claim 3, wherein the plurality of panels further includes inner roof panels, each inner roof panel including fifth mating surfaces for mating with the second mating surfaces on the roof panels; and wherein the third connectors are disposed proximate the middle of each roof panel, whereby portions of each roof panel extend outwardly from the wall panels forming cantilevered arms for supporting the inner roof panels.

17. The system according to claim 2; wherein the second connector on the base panels comprises a female connector for receiving the male connector extending from an end of a wall panel; wherein at least one of the service conduits in the wall panels extends through the male connector; and wherein at least one of the access conduits in the base panels extends to the female connector; whereby the male and female connectors connect the wall panels to the base panels, and align service conduits in the wall panels with access conduits in the base panels.

18. The system according to claim 2, the plurality of service conduits includes first, second, third, fourth, fifth and sixth service conduits.

19. The system according to claim 18, wherein the first and fourth service conduits are for receiving electrical wiring wherein the second and fifth service conduits are for transferring plumbing; and wherein the third and sixth service conduits are for air conditioning.

20. The system according to claim 1, wherein the panels are constructed out of one or more of the materials selected from the group consisting of concrete, wood, polymer, and fiberglass.

21. The system according to claim 1, further comprising:

finishing panels mounted on said interlocking panels;

a plurality of brackets for mounting said interlocking panels on said interlocking panels; and a plurality of recesses in said interlocking panels for receiving said brackets.

* * * * *